US005971230A

United States Patent [19]

Tanaka

[11] Patent Number: 5,971,230

[45] Date of Patent: Oct. 26, 1999

[54] SPRAY QUANTITY CONTROL NOZZLE FOR AEROSOL CONTAINER

[75] Inventor: Shin Tanaka, Osaka, Japan

[73] Assignee: Soft 99 Corporation, Osaka, Japan

[21] Appl. No.: 09/228,574

[22] Filed: Jan. 12, 1999

Related U.S. Application Data

[62] Division of application No. 08/800,539, Feb. 18, 1997.

[30] Foreign Application Priority Data

Apr. 4, 1996 [JP] Japan ..... 8-4467
May 20, 1996 [JP] Japan ..... 8-5398

[51] Int. Cl.[6] ..... B65D 83/20

[52] U.S. Cl. ..... 222/402.11; 222/402.1; 222/402.13; 222/402.15

[58] Field of Search ..... 222/153.11, 402.1, 222/402.11, 402.13, 402.15, 507

[56] References Cited

U.S. PATENT DOCUMENTS

| | | | |
|---|---|---|---|
| 2,921,722 | 1/1960 | Focht | 222/402.13 |
| 3,249,260 | 5/1966 | Goldberg | 222/402.11 |
| 3,474,939 | 10/1969 | O'Donnell et al. | 222/402.11 |
| 3,549,059 | 12/1970 | Sloan | 222/402.15 |
| 3,608,791 | 9/1971 | Jordan et al. | 222/402.11 |
| 3,844,448 | 10/1974 | Sette | 222/402.11 |
| 3,848,778 | 11/1974 | Meshberg | 222/402.11 |
| 4,013,231 | 3/1977 | Van Veldhoven | 222/402.11 |
| 4,413,756 | 11/1983 | Kirley | 222/420.11 |
| 4,454,966 | 6/1984 | Hicks | 222/402.11 |
| 5,085,347 | 2/1992 | Hayes et al. | 222/402.1 |
| 5,366,118 | 11/1994 | Ciamitti et al. | 222/402.11 |
| 5,368,473 | 11/1994 | Kenjiro et al. | 222/402.11 |
| 5,379,924 | 1/1995 | Taylor | 222/402.13 |
| 5,388,730 | 2/1995 | Abbott et al. | 222/402.11 |
| 5,503,303 | 4/1996 | La Ware et al. | 222/402.13 |
| 5,531,359 | 7/1996 | Winner | 222/153.11 |

FOREIGN PATENT DOCUMENTS

| | | |
|---|---|---|
| 627480 | 9/1961 | Canada . |
| 57 130565 | 8/1982 | Japan . |

*Primary Examiner*—J. Casimer Jacyna
*Attorney, Agent, or Firm*—Armstrong, Westerman, Hattori, McLeland & Naughton

[57] ABSTRACT

A spray quantity control nozzle for use in an aerosol container wherein spray quantities of the contents of the aerosol container can be adjusted in two stages as increased or reduced corresponding to specific depression depths of a nozzle body, and a depressible depth H1 of the nozzle body for a smaller spray quantity and that H2 for a larger spray quantity can be surely set, the spray quantity control nozzle comprising a mounting part mounted on a mouth of the aerosol container and the nozzle body fit onto a projecting part of a valve stem of a flow control valve, the nozzle body being connected to the mounting part through a first molded hinge, a movable leaf being connected to the mounting part through a second molded hinge, so that a depressible depth of the nozzle body becomes smaller when the movable leaf is stood up into its working posture, and becomes larger with the movable leaf falling down in its withdrawal posture.

5 Claims, 17 Drawing Sheets

SPRAY QUANTITY CONTROL NOZZLE FOR AEROSOL CONTAINER

This application is a division of prior application Ser. No. 08/800,539 filed Feb. 18, 1997, and still pending.

BACKGROUND OF THE INVENTION

1. Field of the Invention

The present invention relates to a spray quantity control nozzle used for an aerosol container having a flow control valve with a function for varying aerosol flow in two stages.

An aerosol container having a flow control valve with the aforesaid function is disclosed in Japanese Examined Patent Application No. Sho 62-41074 (1987) wherein the flow control valve comprises a valve stem and has such function that a passage for the contents of the aerosol container is closed when the valve stem is positioned in an initial position and is opened when the valve stem at the initial position is depressed; and quantities of the contents flowing through the passage are restrained to be small when the valve stem is depressed into a first depression zone corresponding to a smaller depression of the valve stem from the initial position and are increased when the valve stem is depressed into a second depression zone corresponding to a larger depression of the valve stem from the initial position. Hence, when a spray nozzle mounted to the valve stem is depressed by users with a finger of their hands to cause the valve stem to be pushed into the first depression zone, spray quantities of the contents are made smaller. And when the valve stem is pushed into the second depression zone, the spray quantities are made larger.

2. Description of the Prior Art

The spray nozzle disclosed in the Japanese Publication No. Sho 62-41074 is not provided with a means for precisely defining the two stages of depression depths when the spray nozzle is pushed by the user with a finger. Thus, it is not easy for the users to determine what extent they should depress the spray nozzle to cause the spray quantities to be small or increased as required. The users of the aerosol need to manually arrange or adjust, i.e., reduce or increase, by themselves the depression depths of the spray nozzle while watching the quantities of the contents actually dispensed, so that the flow control valve's stem may be changed in depression depths from the initial position to be brought into the first or the second depression zone to cause the spray quantities to be made smaller or larger.

The manual arrangement of the nozzle's depression depths with watching the quantities of the actually dispensed contents for performing the two stage adjustment of spray quantities is not readily achievable and fails often. In detail, the spray quantities occasionally or often unnecessarily become larger contrary to the user's intention to have smaller spray quantities, or a sufficiently large quantitiy of spraying is not available when the spray quantities are to be increased. Hence, the contents of the aerosol container, for example, paint, is sprayed in an unnecessarily large quantity on a surface to be painted, or spraying on the surface is incomplete, thereby causing that surface to be not excellently finished.

SUMMARY OF THE INVENTION

The present invention has been designed under the above circumstances.

An object of the present invention is to provide a spray quantity control nozzle for an aerosol container which enables a valve stem of a flow control valve provided in the aerosol container to be accurately set in depression depths from an initial position to a first depression zone (smaller depression) or a second depression zone (larger depression), witout using the aforesaid manual arrangement or adjustment.

Another object of the present invention is to provide a spray quantity control nozzle for an aerosol container which, though simple in construction, enables sure performance of the spray quantity control.

A further object of the present invention is to provide a spray quantity control nozzle for an aerozol container which needs only a small operating force.

A further object of the present invention is to provide a spray quantity control nozzle for an aerozol container which includes a function for locking the valve stem at an initial position.

A spray quantity control nozzle for an aerosol container according to the present invention, which has been designed to achieve the aforesaid objects, comprising: the aerosol container having a passage for contents thereof and being provided with a flow control valve and a valve stem, the flow control valve having such functions that the passage of the contents of the aerosol container is closed when the valve stem is positioned in an initial position and is opened when the valve stem at the initial position is depressed, and quantities of the contents flowing through the passage are varied in two stages when the valve stem is depressed into a first depression zone corresponding to a smaller depression of the valve stem from the initial position or into a second depression zone corresponding to a larger depression of the valve stem from the initial position, and the spray quantity control nozzle including: a mounting part fit to a mouth of the aerozol container; a nozzle body which is connected with the mounting part as being capable of being depressed and withdrawing in the direction of the valve stem's depression and is mounted on the valve stem; a spray port provided on the nozzle body, opened at the front side thereof and communicating with the above passage of the aerozol container; a push controller formed on the nozzle body; a space defined between the nozzle body and the mounting part and reducible and extendable in height by depressing and withdrawing the nozzle body; and a movable leaf connected to either the mounting part or the nozzle body, being capable of being positioned and held in the space, and swingable between a working posture wherein the movable leaf is positioned and held in the space and faced to the mounting part or the nozzle body to limit depths of depression of the nozzle body to a smaller extent and a withdrawal posture wherein the movable leaf is withdrawn from that space to the outside.

According to the invention, the movable leaf may be held in the working posture for limiting depths of depression of the nozzle body to a smaller extent, so that when the nozzle body is depressed at its maximum, depression of the valve stem of the flow control valve is limited to a small extent from the initial position corresponding to the depression of the nozzle body. And when the movable leaf is in the withdrawal posture for allowing depths of depression of the nozzle body to be not limited by the movable leaf, the nozzle body is largely depressible to that extent, thereby correspondingly allowing the valve stem of the flow control valve to be depressible in a larger extent from the initial position.

Hence, depths in which the nozzle body is depressible when the movable leaf is in the working posture may be set as corresponding to the first depression zone of the valve stem, and depths in which the nozzle body is depressible with the movable leaf being in the withdrawal posture may include an extent corresponding to the second depression zone. By this feature, the spray quantity of the contents of the aerosol container through the spray port on the nozzle body can be reduced or increased by merely depressing the nozzle body at its maximum corresponding to the working or withdrawal posture of the movable leaf, without using the foregoing manual arrangement.

In this invention, the movable leaf may be connected either to the nozzle body or to the mounting part. The point will be clarified also by the explanation about the examples of the invention described later.

A further spray quantity control nozzle for an aerosol container according to the present invention is so structured that the spray quantity control nozzle is provided by integral molding using synthetic resin; the nozzle body is connected with the mounting part through a first molded hinge placed under the front side of the nozzle body and the movable leaf is connected to the nozzle body or the mounting part through a second molded hinge; and a holding part or a corresponding held part constituting a posture holding mechanism, which holds the working posture of the movable leaf, is formed on the movable leaf, or the mounting part or the nozzle body.

According to this invention, there is no need to use additional or separate parts for connecting the nozzle body to the mounting part or connecting the movable leaf to the mounting part or the nozzle body. And when the movable leaf is set in the working posture by means of the posture holding mechanism, which holds the working posture of the movable leaf, the holding part and the corresponding held part of the posture holding mechanism work together to ensure the movable leaf to be held in the working posture.

A further spray quantity control nozzle for an aerosol container according to the present invention is so constructed that when the nozzle body is depressed with the movable leaf being in the working posture, the valve stem to be depressed together with the nozzle body is limited in depths of depression from its initial position to the range of the first depression zone, and when the nozzle body is depressed with the movable leaf being in the withdrawal posture, depression depths of the valve stem from the initial position may reach the range of the second depression zone.

According to this invention, merely depressing the nozzle body at its maximum correspondingly to the working and the withdrawal postures of the movable leaf without the foregoing manual arrangement enables spray quantities of the contents of the aerosol container through the spray port on the nozzle body to be reduced or increased as desired.

A further spray quantity control nozzle for an aerosol container according to the present invention is so constructed that the push controller of the nozzle body is made of an extension projecting backwardly of the rear side of the nozzle body, and the space reducible and extendable in height corresponding to depressing and withdrawing the nozzle body is formed between the extension and the mounting part.

According to this invention, since the push controller comprises the extension projecting backwardly of the rear side of the nozzle body, an interval extending between the first molded hinge and the push controller can be made longer to thereby enable making use of a principle of "leverage", so that a smaller force may be enough to depress the nozzle body about the first molded hinge.

A further spray quantity control nozzle for an aerosol container according to the present invention comprises the aerosol container having a passage for contents thereof and being provided with a flow control valve and a valve stem, the flow control valve having such functions that the passage of contents of the aerosol container is closed when the valve stem is positioned in an initial position and is opened when the valve stem at the initial position is depressed, and quantities of the contents flowing through the passage are varied in two stages when the valve stem is depressed into a first depression zone corresponding to a smaller depression of the valve stem from the initial position or into a second depression zone corresponding to a larger depression of the valve stem from the initial position, and the spray quantity control nozzle being used for the aerozol container and provided by integral molding by use of synthetic resin and including: a cylindrical mounting part fit to a mouth of the aerosol container; a nozzle body mounted onto the valve stem; a first molded hinge connecting the nozzle body to the mounting part to enable the nozzle body to be movable as being depressed and withdrawn in the direction of depression of the valve stem; a spray port provided on the nozzle body, opened at the front side thereof and communicating with the passage of the aerosol container; a push controller made of an extension projecting backwardly of the rear side of the nozzle body; a space defined between the push controller and the mounting part and reducible and extendable in height by depressing and withdrawing the nozzle body; a flange formed on the mounting part; a hang-down part formed at the flange slantwise as extending downwards and rearwards; a second molded hinge formed at a lower end of the hang-down part; a movable leaf formed in continuation to the hang-down part through the second molded hinge and being swingable, about the second molded hinge, between the working posture and a withdrawal posture wherein the movable leaf is withdrawn from that space to the outside, the movable leaf having a knob means; ribs formed at both lateral sides of the hang-down part; a projection formed on the inner side of each rib; recesses formed at both lateral sides of the movable leaf and engageable with the projections on the ribs when the movable leaf is in the working posture as positioned in the space to be faced to the push controller and fit on the hang-down part; and a groove-like shaped recess formed on the back side of the flange and fit onto the mouth of the mounting cup of the container.

According to this invention, the spray quantity control nozzle may be concretely structured.

A further spray quantity control nozzle for an aerosol container according to the present invention comprises the aerosol container having a passage for contents thereof and being provided with a flow control valve and a valve stem, the flow control valve having such functions that the passage of contents of the aerosol container is closed when the valve stem is positioned in an initial position and is opened when the valve stem at the initial position is depressed, and quantities of the contents flowing through the passage are varied in two stages when the valve stem is depressed into a first depression zone corresponding to a smaller depression of the valve stem from the initial position or into a second depression zone corresponding to a larger depression of the valve stem from the initial position, and the spray quantity control nozzle including: a nozzle body mounted onto the valve stem; a cap member fit onto the outside of and rotatably mounted to the mouth of the aerosol container which mouth is arranged to encircle the valve stem; a depression depths limiting part formed on the cap member; a spray port provided on the nozzle body, opened at the front side thereof and communicating with the passage of the aerosol container; a push controller made of an extension projecting backwardly of the nozzle body; a head part formed on the nozzle body and having an abutting part which is faced to the depression depths limiting part when the valve stem is positioned in the initial position; an upper receiving part which is formed at the depression depths limiting part and receives the abutting part when a depressing force is applied to the valve stem through the push controller and before the valve stem reaches the first depression zone; a middle receiving part which is formed at the depression depths limiting part to line up with the upper receiving part in the direction of rotation of the cap member and receives the abutting part when a depressing force is applied to the valve stem through the push controller and at a point where the valve stem reaches the first depression zone; and a lower receiving part which is formed at the depression depths limiting part to line up with the upper or the middle receiving part in the direction of rotation of the cap member and receives the abutting part when a depressing force is applied to the valve stem through the push controller and at a point where the valve stem reaches the second depression zone.

According to this invention, the cap member is turned to cause the upper receiving part at the depression depths limiting part to face to the abutting part on the nozzle body, so that even when the push controller of the nozzle body is operated to apply a depressing force to the valve stem, the abutting part is received by the upper receiving part before the valve stem reaches the first depression zone, whereby the valve stem cannot be depressed into the first depression zone and is locked in the initial position, which is a lock mode.

The cap member may be turned to cause the middle receiving part at the depression depths limiting part to face to the abutting part on the nozzle body, so that when the push controller on the nozzle body is operated to apply a depressing force to the valve stem and the abutting part is received by the middle receiving part, the valve stem reaches the first depression zone, whereby the valve stem is depressed into the first depression zone corresponding to a smaller depression, which is a small quantity spray mode.

The cap member may be further turned to cause the lower receiving part at the depression depths limiting part to face to the abutting part on the nozzle body, so that when the push controller on the nozzle body is operated to apply a depressing force to the valve stem and the abutting part is received by the lower receiving part, the valve stem reaches the second depression zone, whereby the valve stem is depressed into the second depression zone corresponding to a larger depression, which is a large quantity spray mode.

A further spray quantity control nozzle for an aerosol container according to the present invention is so constructed that one of the nozzle body and the cap member is provided with a projection and the other is provided at two points in its circumferential direction with stoppers which each engages with the projection, by rotation of the cap member, to limit a range of rotation angles of the cap member to such extent that the abutting part exists within a reach where the abutting part is able to always face to the depression depths limiting part, and a partition means is formed on the said other at two points between the two stoppers which partition means the projection gets over when the cap member is turned to allow the abutting part to be placed within a reach wherein the abutting part is able to face to the upper, the middle or the lower receiving part, so that when the projection gets over each partition means, at least one of the projection or the partition means elastically deforms.

According to this invention, the two stoppers and one projection regulate the range of rotation angles of the cap member to allow the abutting part to exist in a reach where the abutting part is able to always face to the depression depths limiting part. And when the cap member is turned to cause a selected one among the upper, the middle and the lower receiving parts on the cap member to face to the abutting part on the nozzle body, user's ears and his hand gripping the cap member will receive, as signs of switching the operation modes, sounds generated by the projection's getting over each partition means and vibrations produced when the projection or each partition means elastically returns to their original states after their elastically deformation upon the projection's getting over the partition means.

A further spray quantity control nozzle for an aerosol container according to the present invention is so constructed that a shield wall is formed at the outside of the depression depths limiting part on the cap member to extend upwardly from and integrally with the outer periphery of the cap member, and the upper, the middle and the lower receiving parts of the depression depths limiting part are consecutively provided at the rear side of the shield wall integrally therewith.

According to this invention, the upper, the middle and the lower receiving parts are covered with the shield wall to thereby be out of sight and inconspicuous.

A further spray quantity control nozzle for an aerosol container according to the present invention is so constructed that the nozzle body is provided with a mounting part fit onto the inside of and mounted to the mouth of the aerosol container, and with a flange extended from the mounting part to be fit onto the mouth of the container; the head part of the nozzle body is connected to the mounting part through a hinge to be depressed and withdraw in the direction of depression of the valve stem; the said other is the nozzle body; and the stoppers and the partition means are provided at the flange.

According to this invention, the nozzle body can be stably mounted to the valve stem and is firmly fixed to the mouth of the aerozol container through the mounting part and the flange, so that when the cap member is turned to switch the spray modes, the nozzle body can be surely prevented from rotating following the cap member.

Various characteristics and effects of the present invention will be further clarified by the following explanation of specific examples.

DETAILED DESCRIPTION OF THE INVENTION

Figure 3:
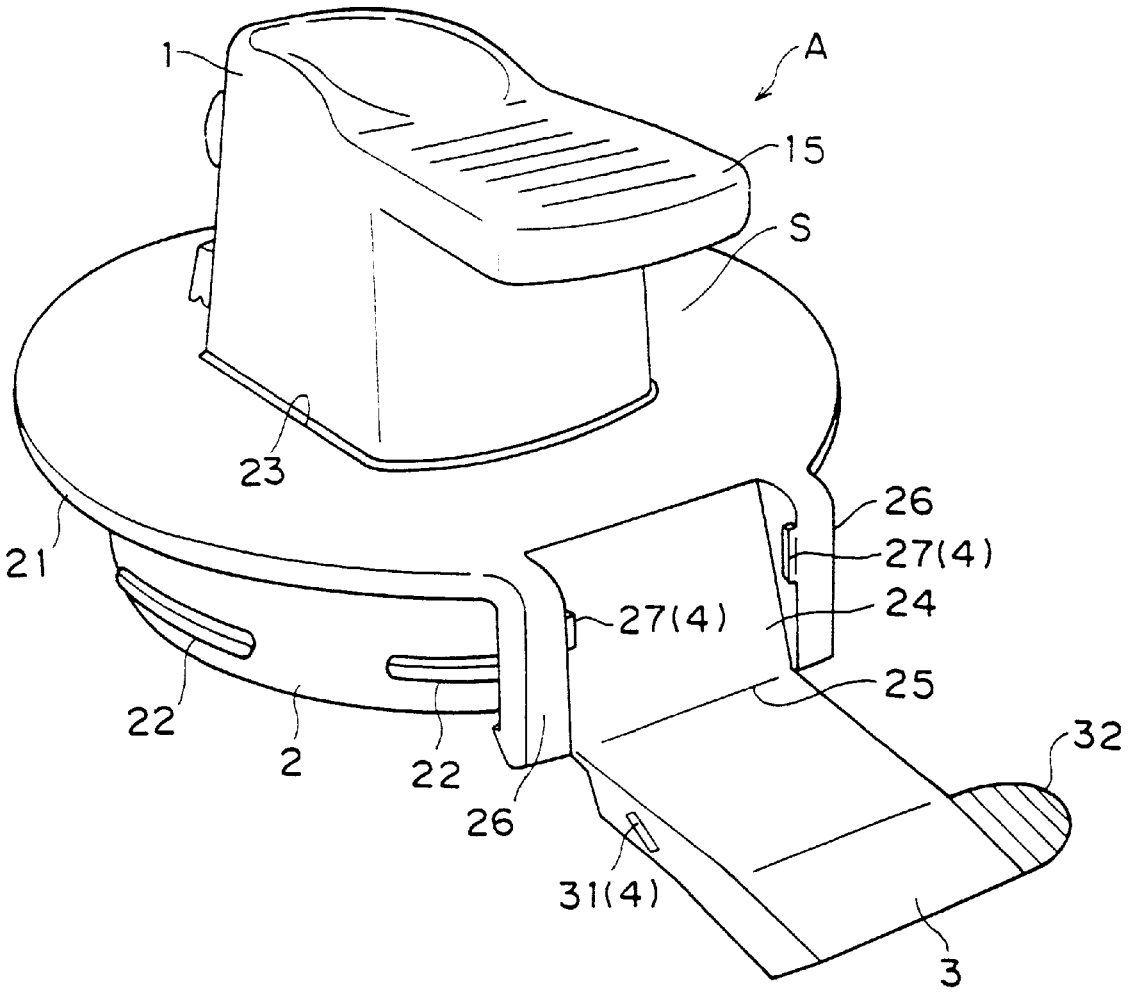
FIG. 3 is a schematic perspective view of the spray quantity control nozzle shown in FIG. 1.
Figure 4:
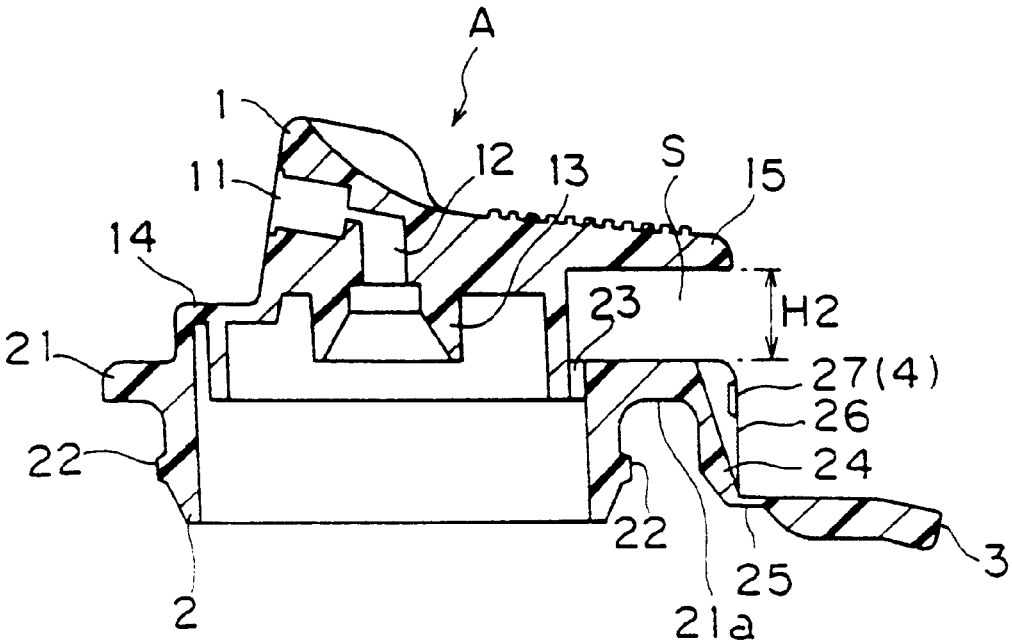
FIG. 4 is a longitudinally sectional side view of the nozzle shown in FIG. 1 with a movable leaf in a withdrawal posture.
Figure 5:
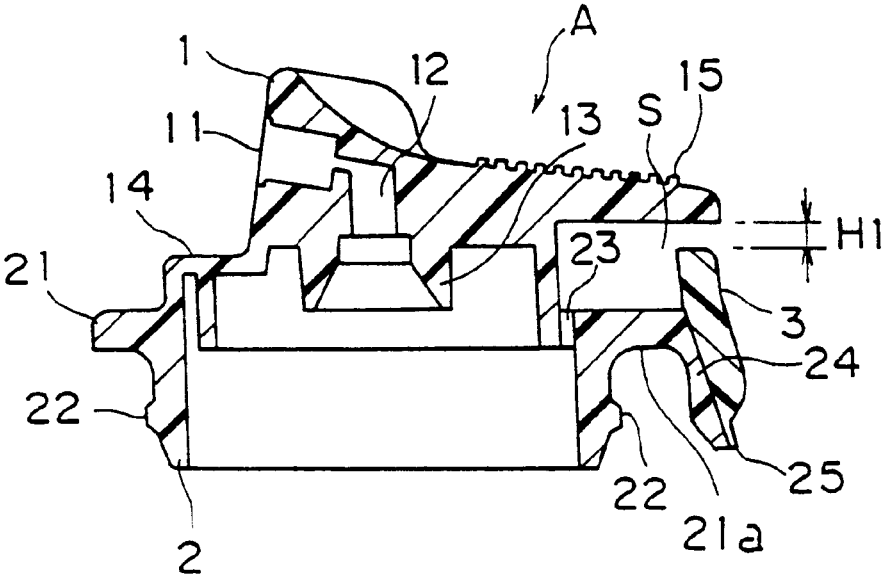
FIG. 5 is a longitudinally sectional side view of the same with the movable leaf in a working posture.

FIGS. 3 to 5 illustrate details of a spray quantity control nozzle A (called hereunder the "nozzle") in a first example. The nozzle A is formed by integral molding using synthetic resin and comprises a cylindrical mounting part 2 having a flange 21 and a nozzle body 1 molded in the shape projecting upwardly of the flange 21. The mounting part 2 has a plurality of ridge-shaped ribs 22 on the outer periphery.

The nozzle body 1 has a spray port 11 opened at the front side of the nozzle body, and a passage 12 communicating with the spray port 11. The communication passage 12 communicates with a connection port 13 formed on the nozzle body 1. The nozzle body 1 is connected only at its front lower part to the mounting part 2 through a first molded hinge 14 which is thin in thickness and has elasticity. The mounting part 2 has an opening 23 through which the nozzle body 1 is allowed to swing vertically about the first molded hinge 14. Hence, the nozzle body 1 is depressed at its push controller 15 (described later) by a finger of user's hand to be pushed in about the first molded hinge 14 in the direction of depression of a valve stem 7 (described later), and withdraws or returns to its original position by slackening the depressing force and thanks to an elastically restoration force of the first molded hinge 14.

The push controller 15 is made of an extension projecting backwardly of the rear side of the nozzle body 1, so that an interval between the first molded hinge 14 and the push controller 15 can be made longer, whereby thanks to a principle of "leverage" a smaller force is enough to depress the nozzle body 1 about the first molded hinge 14 by use of a finger of user's hands. A space S is defined between the push controller 15 made of the extension and the flange 21 on the mounting part 2 and is reduced or increased in height by depressing or withdrawing the nozzle body 1. Provision of the space S enables the depressing and withdrawal movement of the nozzle body 1.

A hang-down part 24 is formed at the flange 21 of the mounting part 2 and extends slantwise downward and rearward. A movable leaf 3 is formed in continuation to the lower end of the hang-down part 24 through a second molded hinge 25 which is thin in thickness and has elasticity. The movable leaf 3 has a protuberance 32 serving as a knob. Ribs 26 are formed at both lateral sides of the hang-down part 24 and have projections 27 (an example of a holding part) on the inner surfaces. The movable leaf 3 has corresponding recesses 31 at its both lateral sides. The movable leaf 3 is stood up about the second molded hinge 25 to be pushed between the ribs 26 as seen in FIG. 5, and then brought into contact with or fit on the hang-down part 24 to be positioned in the space S, so that the projections 27 are engaged with the recesses 31 to hold the movable leaf 3 in the stood-up state, which state is the working posture of the movable leaf 3. The movable leaf 3 in the working posture faces close at its upper end to the push controller 15 of the nozzle body 1, whereby a depressible depth H1 of the nozzle body 1 is limited to a smaller extent as seen in FIG. 5. And when the movable leaf 3 in the working posture is pulled outwardly to disconnect the projections 27 from the recesses 31 to cause the movable leaf 3 to fall and withdraw outwardly from the space S and be brought into the withdrawal posture as shown in FIGS. 3 and 4, the depressible depth (H2 in FIG. 4) of the nozzle body 1 is not limited by the movable leaf 3 and thereby corresponds to the whole height of the space S.

The projections 27 and recesses 31 constitute a posture holding mechanism 4 provided between the movable leaf and the mounting part 2.

Next, an example of a flow control valve 5 (called hereunder the "valve") provided in the container B will be explained with referring to FIGS. 24 to 26.

Figure 1:
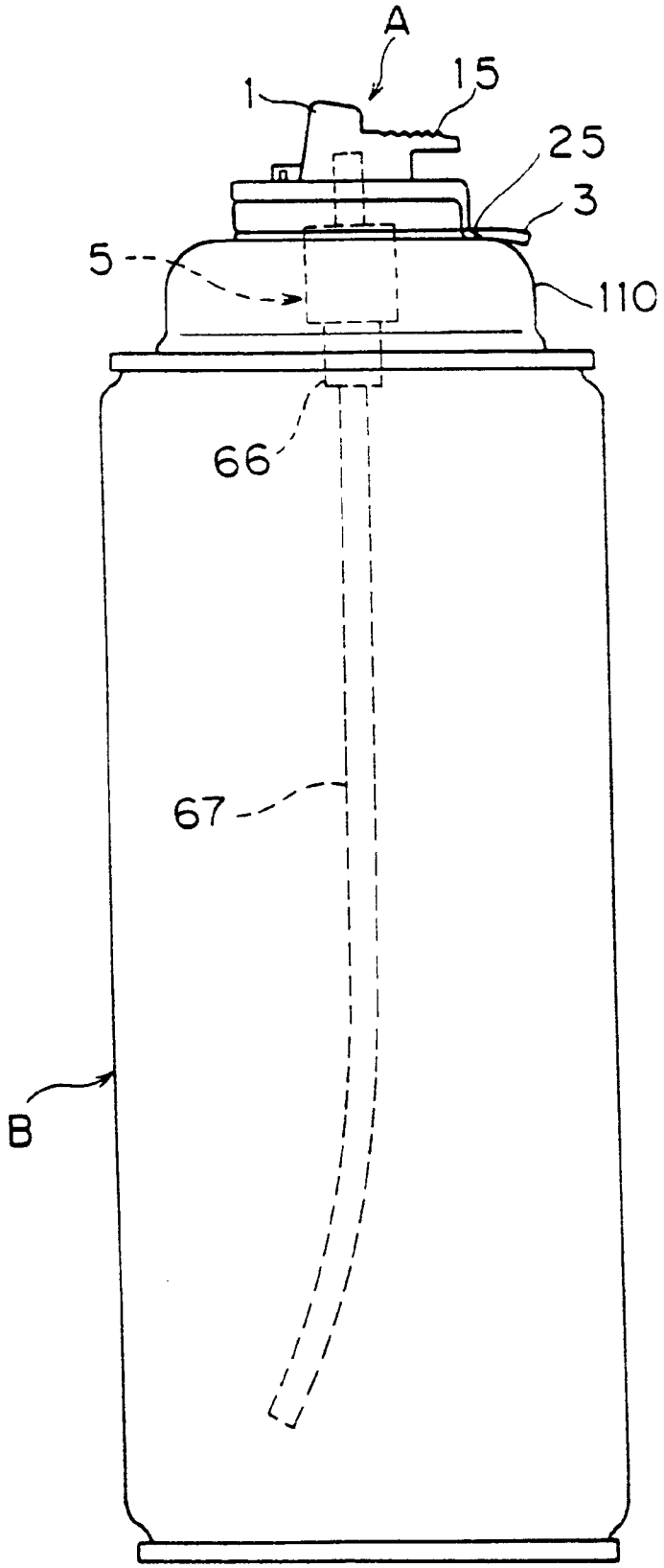
FIG. 1 is a side view of an aerosol container mounting a spray quantity control nozzle of an example according to the present invention.

The valve 5 has a housing 6 fixed to a mounting cup 110 of the container B. The housing 6 holds a gasket 62 at its upper end 61 and is provided on a bottom wall 63 with a valve hole 64, a valve seat 65 and a connection port 66 to which a dip tube 67 is connected as seen in FIG. 1.

A valve stem 7 is inserted through a hole 68 of the gasket 62 with a neck 71 having a smaller diameter being fit in the hole 68, a larger diameter portion 72 extending under the neck 71 and freely inserted in the housing 6 to be shiftable in the direction X (FIG. 24), and a projecting part 73 extending upwardly of the neck 71 through the opening of the mounting cup 110. The valve stem 7 has a bore 74 opened on the outer peripheral surface of the neck 71 and at the upper end of the projecting part 73, and the opening of the bore 74 on the outer periphery of the neck 71 is moved away from and contacted with the gasket hole 68 by depressing and returning the valve stem 7. The stem bore 74 serves as a passage of the contents of the aerosol container.

The larger diameter portion 72 of the valve stem 7 has a recess 75 whose upper wall serves as an abutting part 76 for depressing a secondary valve stem 8 described hereunder. The recess 75 is provided at its lower end on the inner peripheray with a pawl 77 for lifting the secondary valve stem 8. The secondary valve stem 8 is inserted through the valve hole 64 and has a head 81 inserted into the recess 75 with an upper end surface of the head 81 serving as a receiving part 82 corresponding to the abutting part 76, and a stepped part at the lower end of the head 81 serving as an engaging part 83 corresponding to the pawl 77. The head 81 of the secondary valve stem 8 is held shiftably between the abutting part 76 and the pawl 77 in the axial direction X. The secondary valve stem 8 has a communication passage 84 and a valve 85 and is held by a stem holding member 86 provided in the housing 6. The stem holding member 86 is made of rubber or elastic synthetic resin and has a central hole 87 which hole part contacts with the outer peripheral surface of the secondary valve stem 8 to have a frictional resistance against the stem 8 and hold the same with the frictional resistance. The stem holding member 86 has a quality to allow the valve stem 8 to slide by a force in the axial direction X when the force is applied to the secondary valve stem 8. The hole part 87 of the holding member 86 has a cut 88 which allows the valve hole 64 to always communicate with the inner space of the housing 6.

A spring member 9 including a coiled spring is interposed between the valve stem 7 and the holding member 86 for the secondary valve stem 8 and always does, by its spring force, urge upwardly the valve stem 7 toward its initial position.

Figure 24:
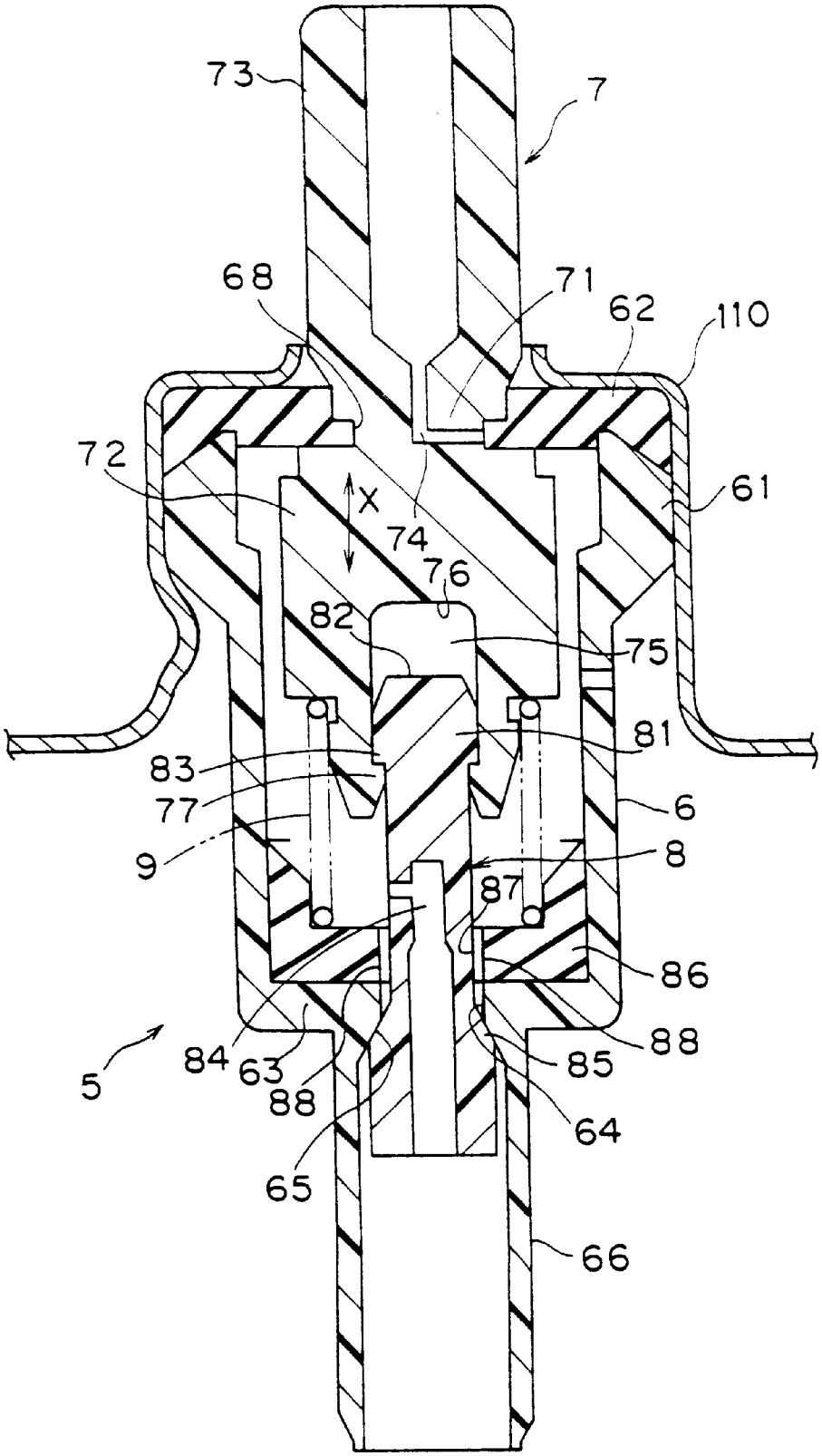
FIG. 24 is a sectional view showing a structure of a flow control valve with the valve stem being positioned in an initial position.

In the valve 5 structured in the above manner, the valve stem 7 in a usual state is positioned in the initial position shown in FIG. 24 by the force of the spring member 9, and the stem hole 74 is closed by the gasket 62. When the valve stem 7 at the initial position is pushed in to be operated as indicated by the arrows P1 and P2 shown in FIGS. 25 and 26, the gasket 62 is deflected and deformed to open the stem hole 74.

Figure 25:
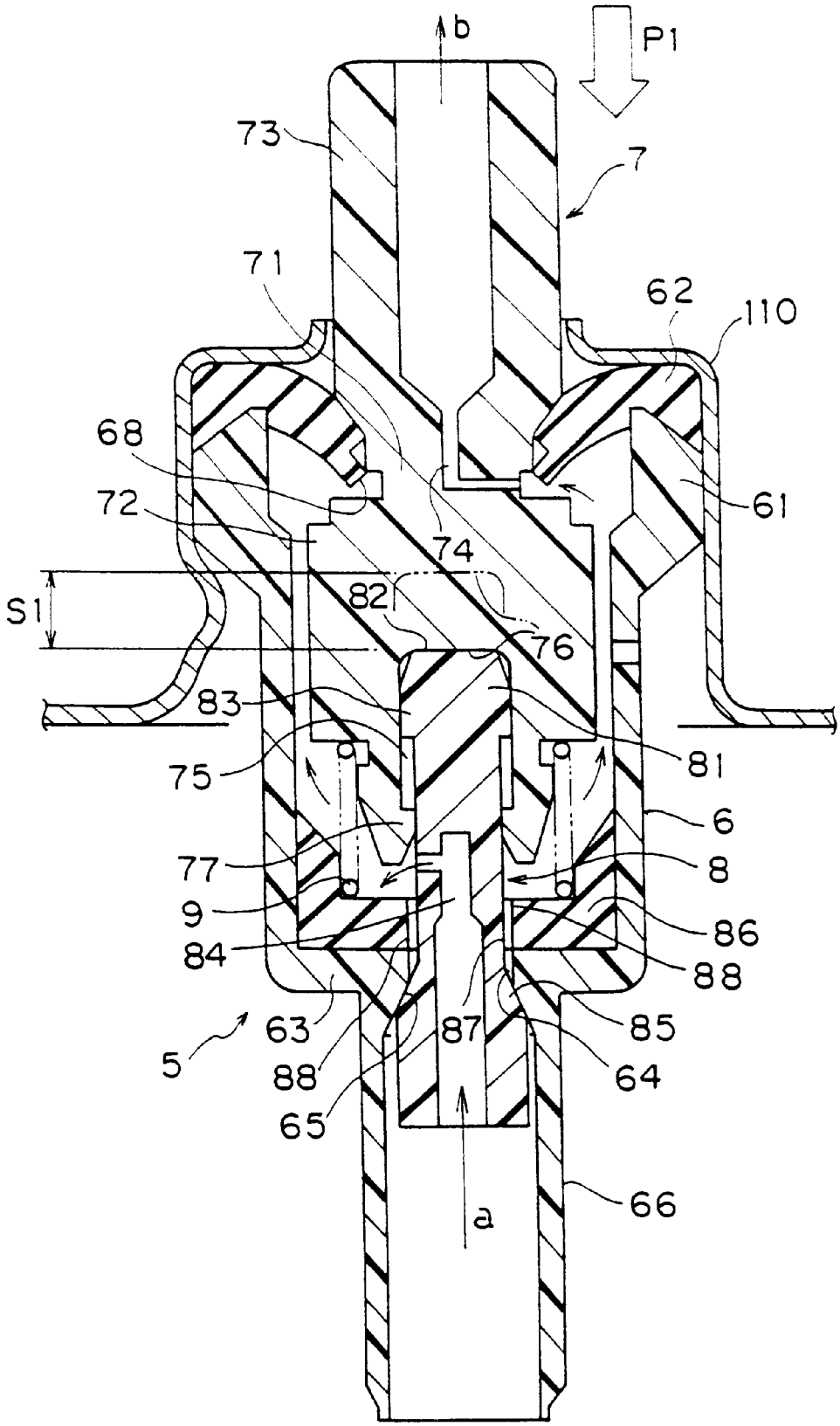
FIG. 25 is a sectional view showing the structure of the flow control valve with a depression depth of the valve stem from the initial position being in a first depression zone.

FIG. 25 illustrates the valve stem 7 being depressed until the abutting part 76 abuts against the receiving part 82 of the secondary valve stem 8. The depth of depression of the valve stem 7 from the initial position is small and such range of smaller depression from the initial position is the first depression zone designated by the reference S1. When the depression depth of the valve stem 7 is in the range of the first depression zone S1, the stem hole 74 is open and communicates with the communication passage 84 in the secondary valve stem 8 through the inner space of the housing 6, so that the liquid contents contained in the container B shown in FIG. 1 rises in the dip tube 67 by pressure of a gas sealed in the gaseous phase part of the contents to go into the inner space of the housing 6 only through the communication passage 84 as indicated by the arrow a in FIG. 25 and then flows out through the stem hole 74 as indicated by the arrow b.

Figure 26:
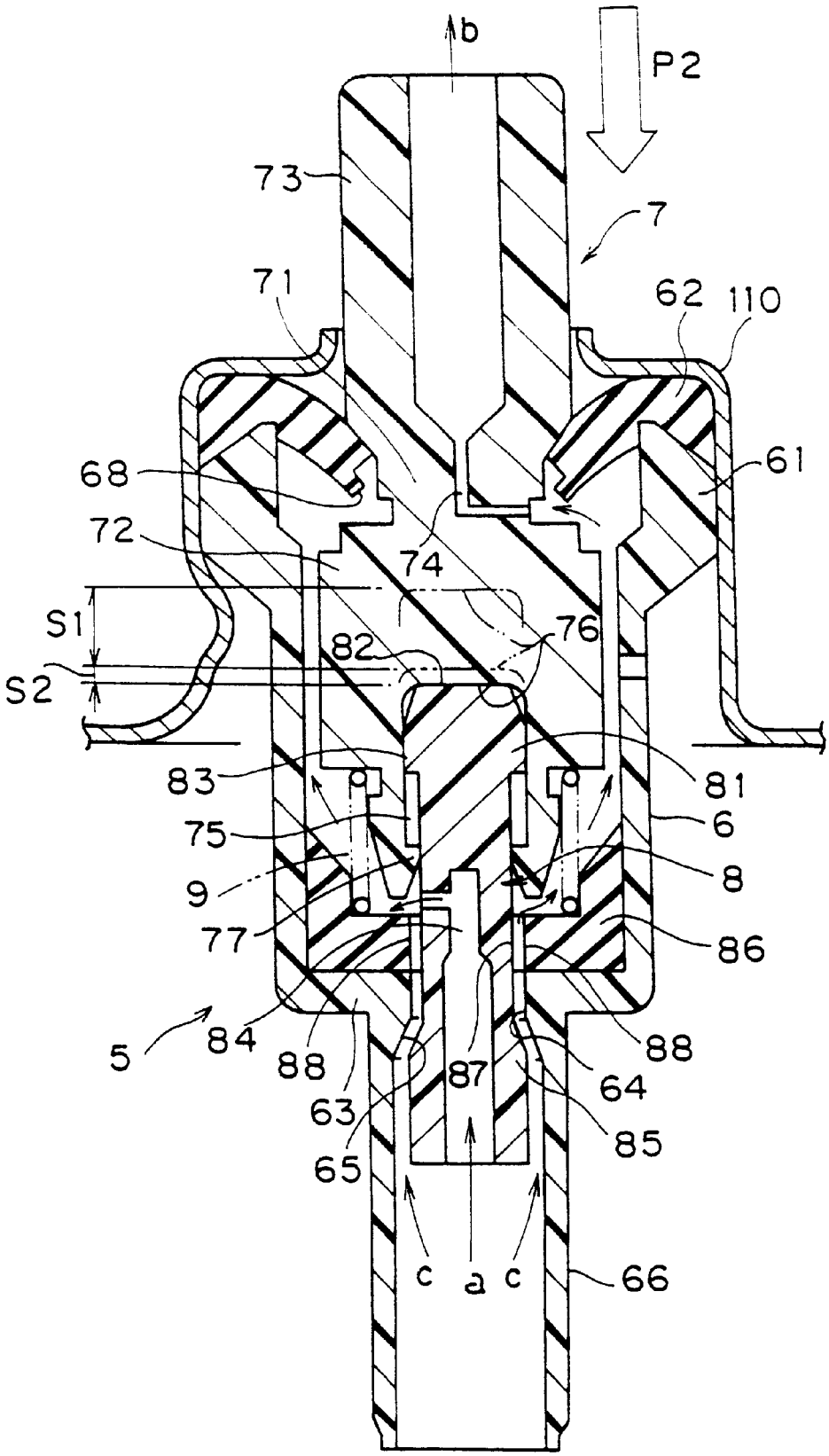
FIG. 26 is a sectional view showing the structure of the flow control valve with a depression depth of the valve stem from the initial position being in a second depression zone.

FIG. 26 shows the valve stem 7 being further depressed after the abutting part 76 abuts on the receiving part 82. In this case, the depth of depression of the stem 7 from the initial position is large and such range of larger depression from the initial position is the second depression zone designated by the reference S2. As seen in FIG. 26, the first depression zone S1 and the second depression zone S2 extend consecutively. When the depth of depression of the valve stem 7 is in the range of the second depression zone S2, the secondary valve stem 8 is pushed down together with the valve stem 7 to cause the valve 85 to be moved away from the valve seat 65 and open the valve hole 64, so that both the communication passage 84 and the valve hole 64 communicate with the inner space of the housing 6 to cause the liquid contents of the container B to rise in the dip tube 67, go into the inner space of the housing 6 through the communication passage 84, valve hole 64 and cut 88 at the stem holding member 86 as indicated by the arrows a and c, and flow out through the stem hole 74 indicated by the arrow b. Hence, when the depth of depression of the stem 7 from the initial position is in the range of the second depression zone S2, the liquid contents flows out more through the stem hole 74 in comparison with the case explained in FIG. 25.

The valve stem 7 when released from the depressing force returns to the initial position shown in FIG. 24 thanks to a force of the spring member 9 to cause the gasket 62 to restore into the original shape and close the stem hole 74, and the secondary valve stem 8 is lifted following the returning of the stem 7 to the initial position, thereby causing the valve 85 to abut against the valve seat 65 and close the valve hole 64.

Figure 2:
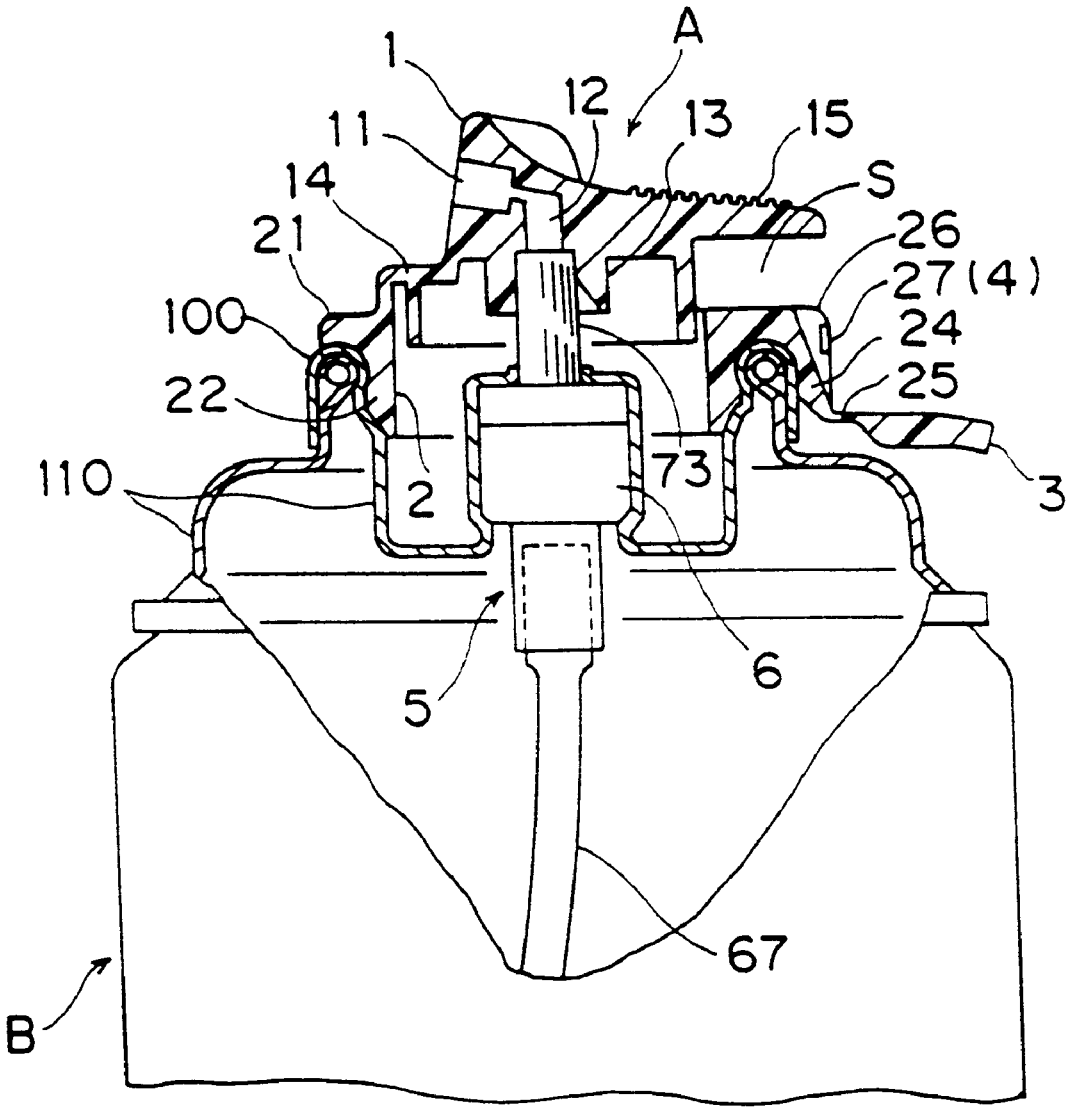
FIG. 2 is a partially exploded side view of a principal portion of the aerosol container shown in FIG. 1.

Explanation is again on the nozzle A. As seen in FIGS. 1 and 2, the nozzle A is mounted on the container B with the mounting part 2 being fit inside a mouth 100 of a mounting cup 110 of the container B. In this case, the flange 21 may be provided on its lower surface with a groove-shape recess 21a (FIGS. 4 and 5) which fits onto the mouth 100 to enable the nozzle A to be mounted stably firmly on the container B. Furthermore, the connection port 13 of the nozzle body 1 is fit onto the projecting part 73 of the valve stem 7 in the foregoing flow control valve 5 to allow the stem hole 74 to communicate with the spray port 11 through the communication passage 12.

In the shown nozzle A, the nozzle body 1 and the valve stem 7 has such correlation that when the nozzle body 1 is pushed in to an extent corresponding to the depth H1, in which the nozzle body 1 is depressible with the movable leaf 3 being set in the working posture as shown in FIG. 5, the depression depth from the initial position of the valve stem 7 depressed together with the nozzle body 1 is in the range of the first depression zone S1, i.e., such correlation as H1<S1 or H1=S1 is provided. In addition, when the nozzle body 1 is pushed in to an extent corresponding to the depth H2, in which the nozzle body 1 is depressible with the movable leaf 3 being in the withdrawl posture as shown in FIG. 4, the depression depth of the valve stem 7 from the initial position reaches the range of the second depression zone S2, i.e., such correlation H2>S1 is provided.

Hence, the movable leaf 3 is set to the working posture as shown in FIG. 5 to limit the depressible depth H1 of the nozzle body 1 to the smaller range, and the push controller 15 on the nozzle body 1 is merely pushed in without the special manual arrangement, so that the spray quantity of the contents through the spray port 11 is made smaller. And the movable leaf 3 is set to the withdrawal posture as shown in FIGS. 1 to 4 to allow the depressible depth H2 (FIG. 4) of the nozzle body 1 to be not limited by the movable leaf 3, and the push controller 15 is pushed in without the special manual arrangement, so that the spray quantity from the spray port 11 increases.

Figure 6:
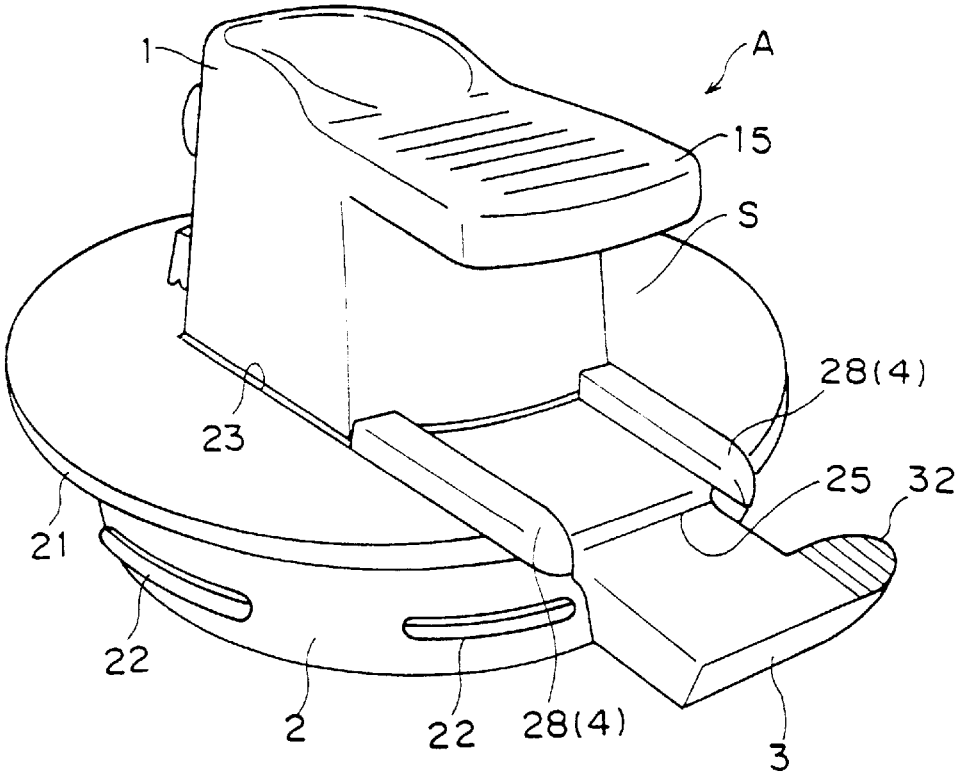
FIG. 6 is a schematic perspective view of a spray quantity control nozzle according to the present invention in another example.
Figure 7:
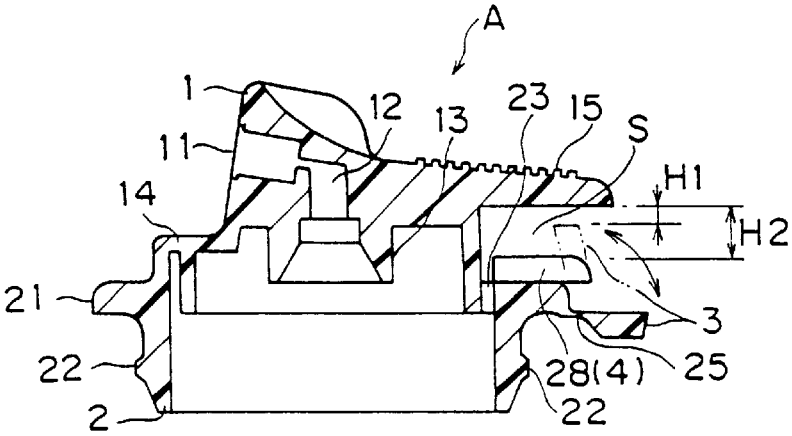
FIG. 7 is a longitudinally sectional side view of the nozzle shown in FIG. 6.

Next, another example of the invention will be explained with referring to FIGS. 6 and 7. The nozzle A in this example has a pair of projections 28, which project on the flange 21 to sandwich and hold the movable leaf 3 in the working posture, instead of the hang-down part 24 and ribs 26 exemplified in FIGS. 2 to 5. In this example, the posture holding mechanism 4 is formed by the projections 28. The movable leaf 3 is connected with the flange 21 through a second molded hinge 25. Other structures and functions are the same as those of the nozzle A explained in FIGS. 1 to 5 and are not detailed here for convenience of explanation. The same parts as those referred to in the foregoing explanation have the same reference numerals or signs in this example. In FIG. 7, the movable leaf in the working posture is illustrated by a phantom line.

Figure 8:
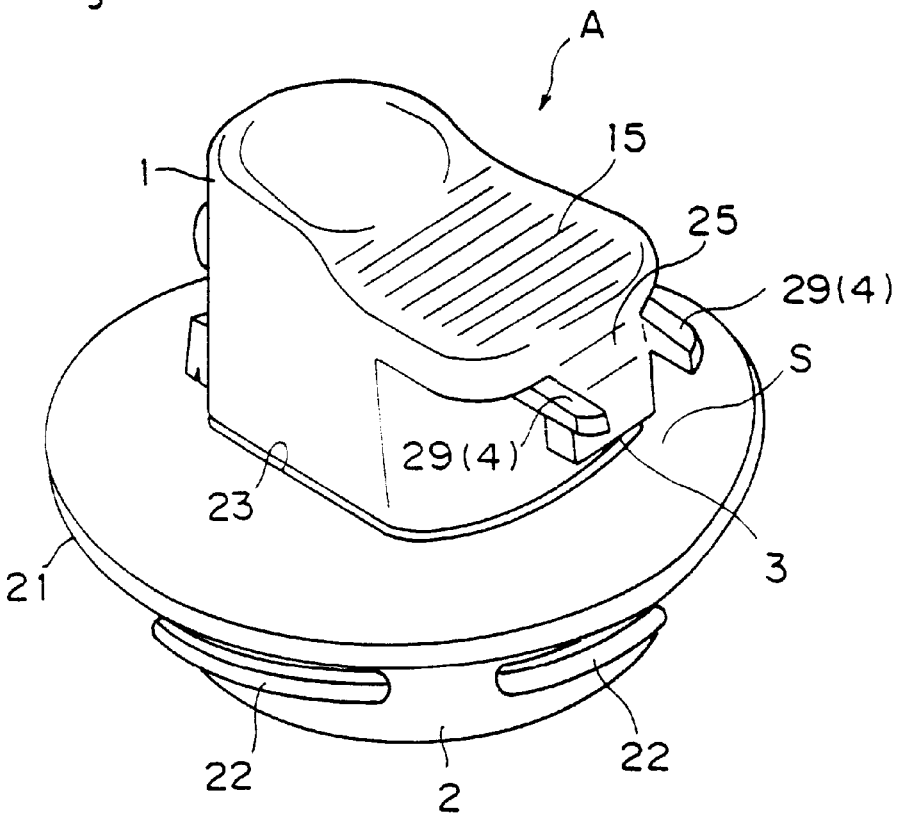
FIG. 8 is a schematic perspective view of a spray quantity control nozzle according to the present invention in a further example.
Figure 9:
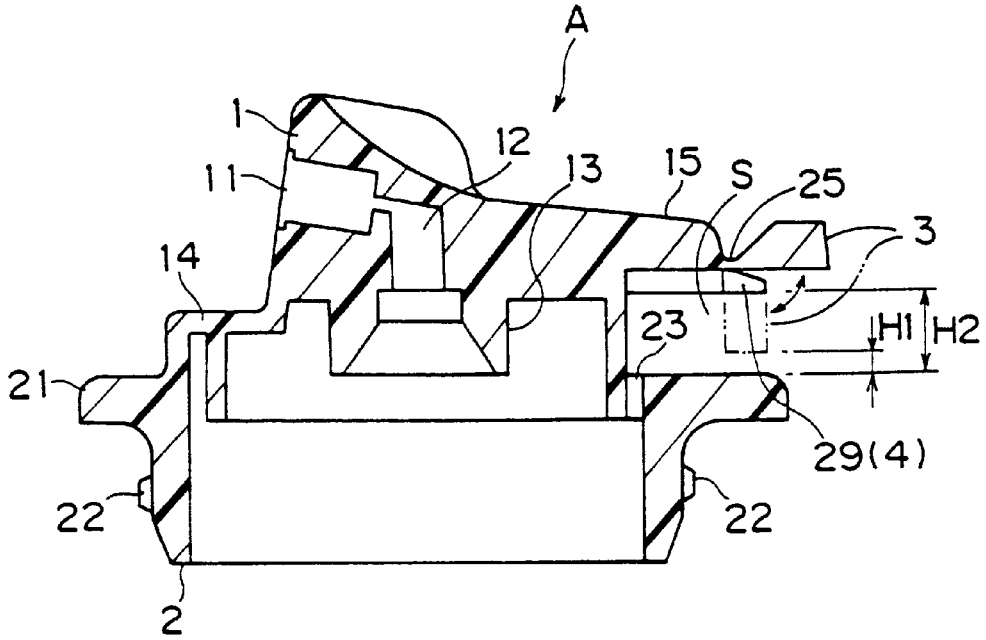
FIG. 9 is a longitudinally sectional side view of the nozzle shown in FIG. 8.
Figure 10:
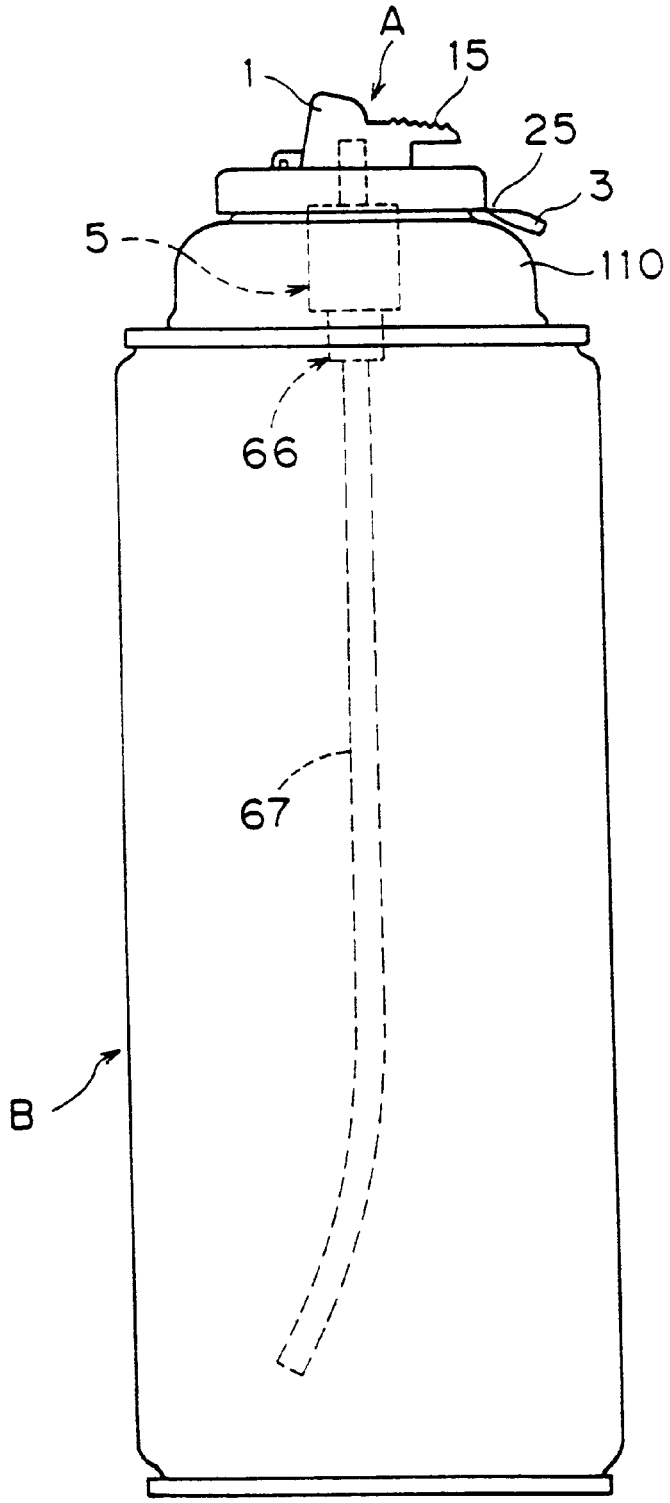
FIG. 10 is a side view showing an aerosol container mounting a spray quantity control nozzle according to the present invention in a further different example.
Figure 11:
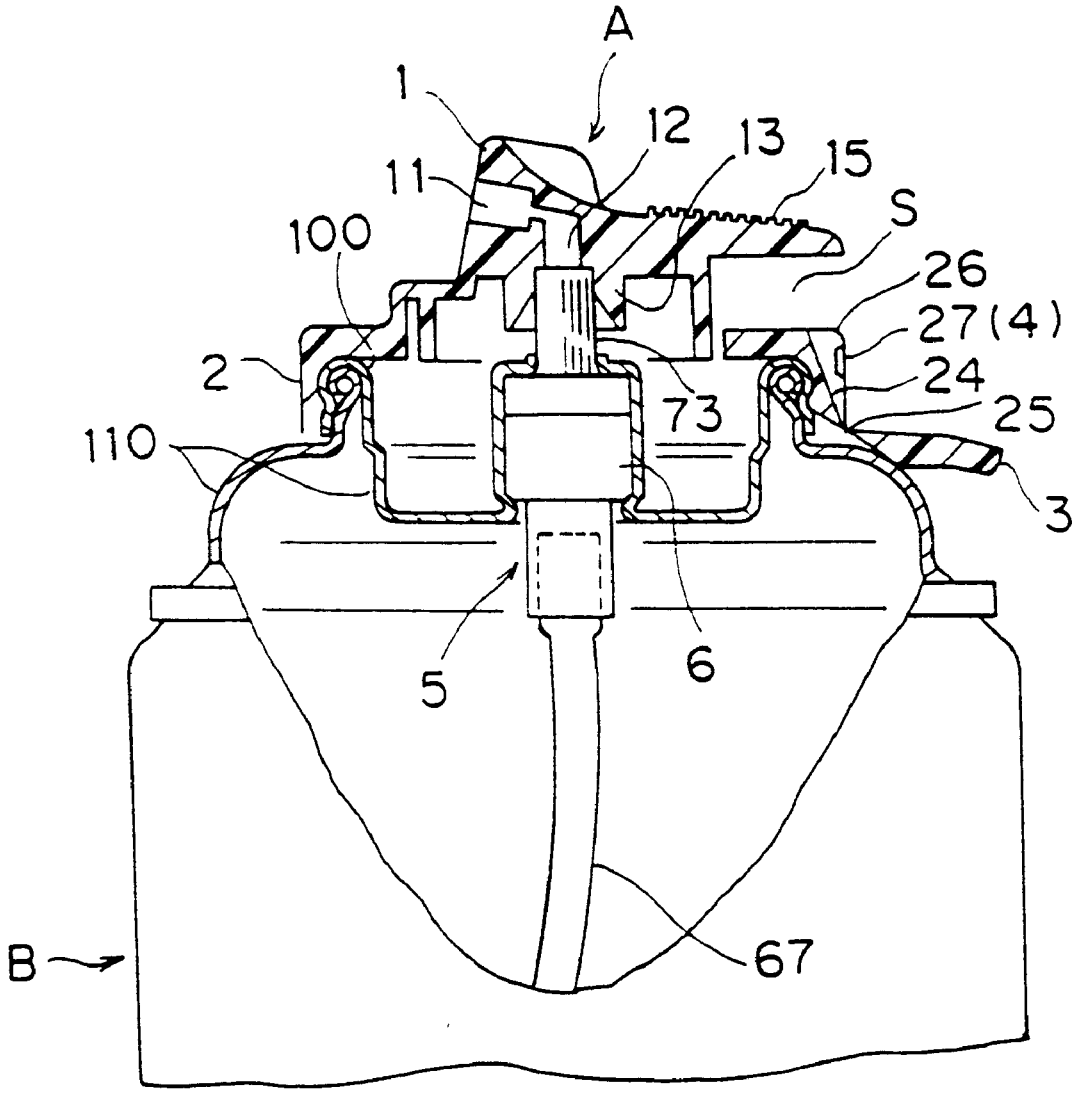
FIG. 11 is a partially exploded side view showing an enlarged principal portion of the container shown in FIG. 10.
Figure 12:
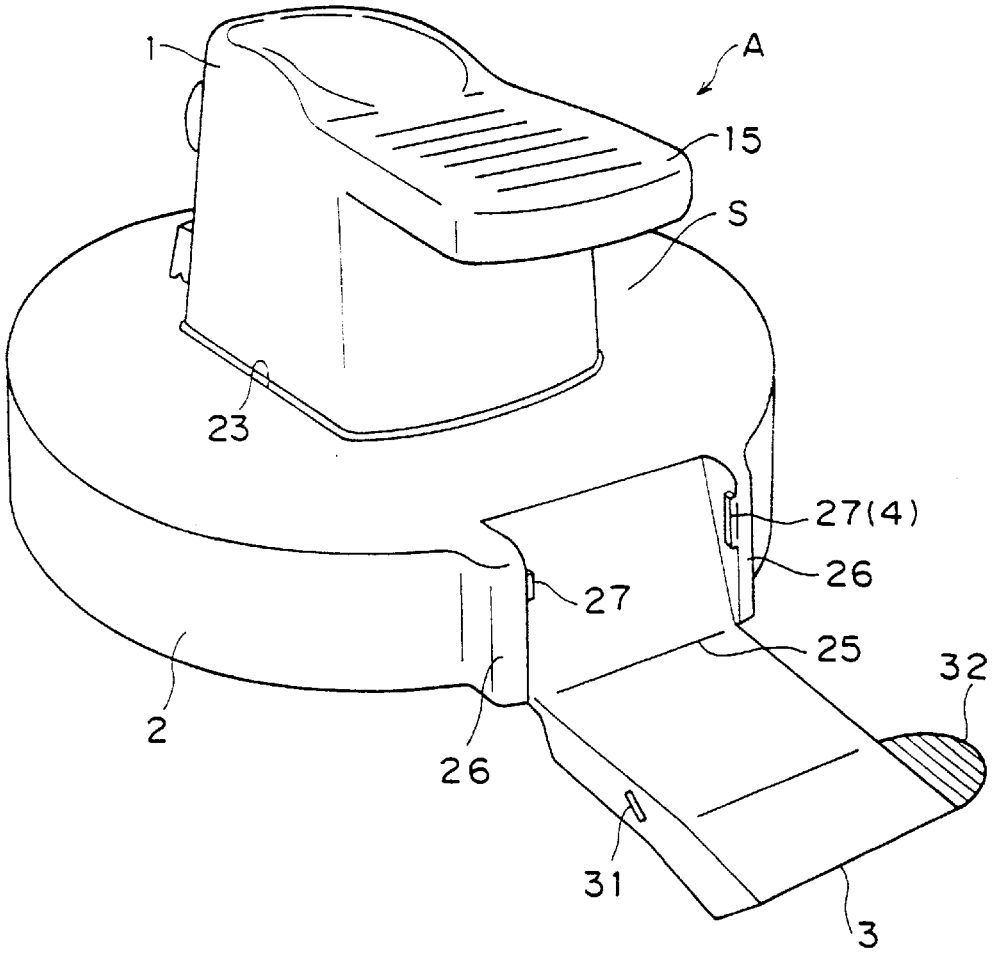
FIG. 12 is a schematic perspective view of the nozzle shown in FIG. 10.

Next, a further example of the invention will be explained with referring to FIGS. 8 and 9. The nozzle A in this example has the movable leaf 3 connected to the the rear end of the push controller 15 of the nozzle body 1 through the second molded hinge 25, and a pair of projections 29 extending from the nozzle body 1 to both lateral sides of the movable leaf 3 to sandwich and hold the movable leaf 3 in the working posture. This example is different only in the feature from the nozzle A referred to in FIGS. 2 to 5. The posture holding mechanism 4 is formed by the projections 29 in this example. Other structures and functions are the same as those of the nozzle A explained in FIGS. 1 to 5 and are not detailed here for convenience of explanation. The same parts as those referred to in the foregoing explanation have the same reference numerals or signs in this example. In FIG. 9, the movable leaf 3 in the working posture is illustrated by a phantom line.

Figure 13:
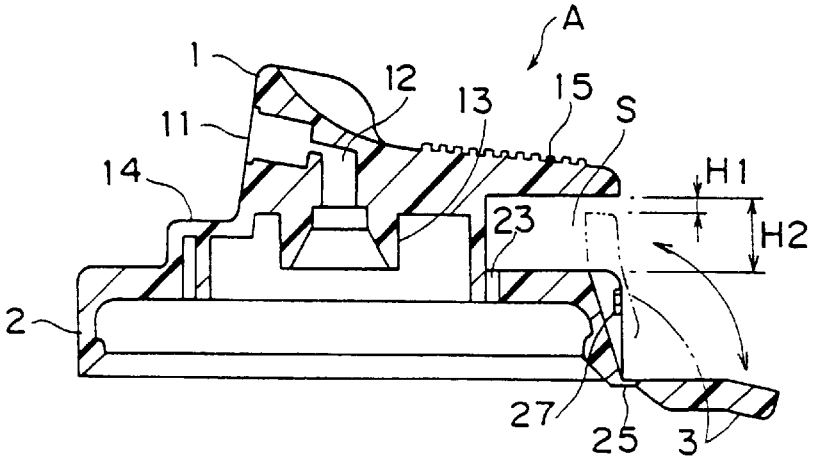
FIG. 13 is a longitudinally sectional side view of the nozzle shown in FIG. 12.

Next, a further example of the invention will be explained with referring to FIGS. 10 to 13. The nozzle A in this example is so structured that the mounting part 2 is fit and mounted to the outside of the mouth 100 of the mounting cup 110 of the container B, only in which feature this example is different from that shown in FIGS. 1 to 5. Other structures and functions are the same as those of the nozzle A explained in FIGS. 1 to 5 and are not detailed here for convenience of explanation. The same parts as those referred to in the foregoing explanation have the same reference numerals or signs in this example. In FIG. 13, the movable leaf 3 in the working posture is illustrated by a phantom line.

Figure 14:
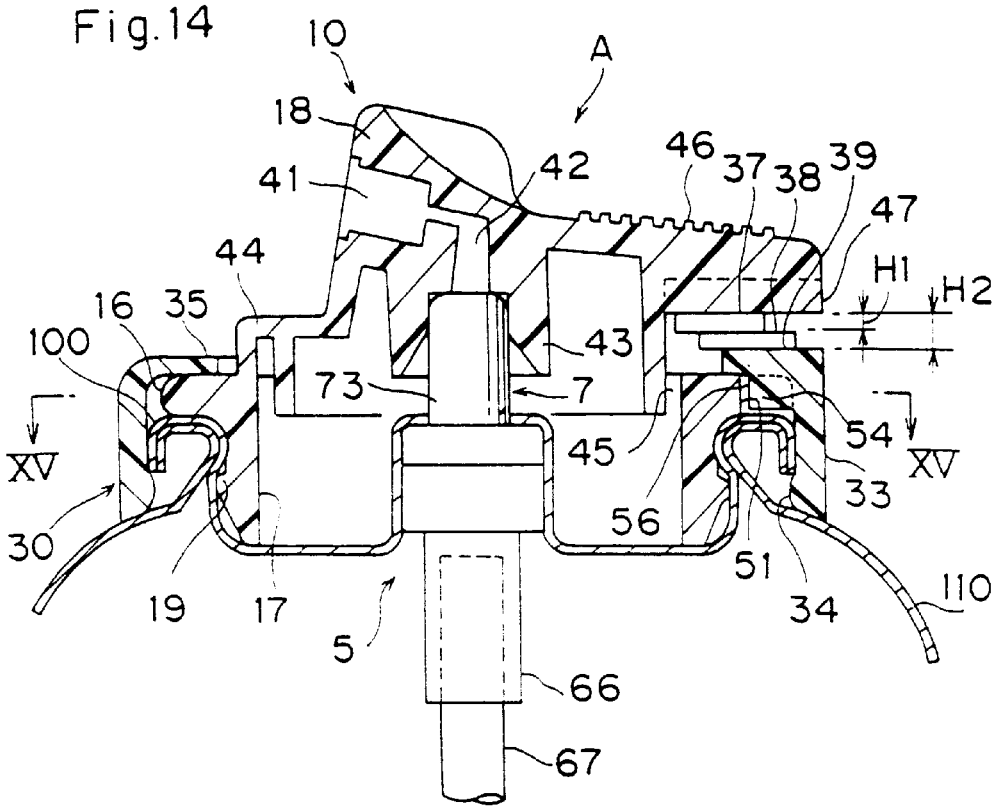
FIG. 14 is a longitudinally sectional side view of a spray quantity control nozzle in a further example according to the present invention mounted to the mouth of an aerosol container.
Figure 15:
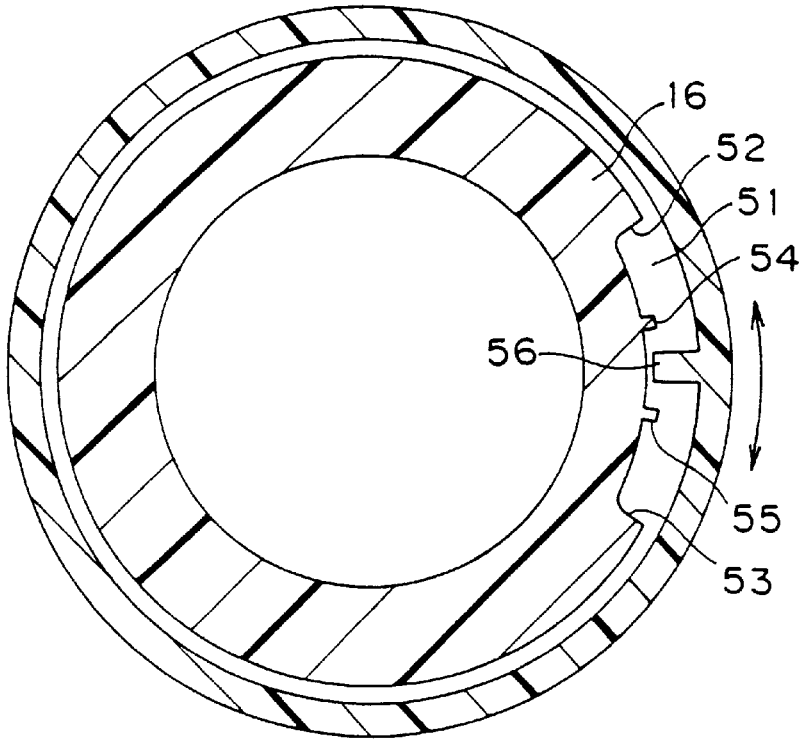
FIG. 15 is a partially omitted sectional view taken in the line XV—XV in FIG. 14.
Figure 16:
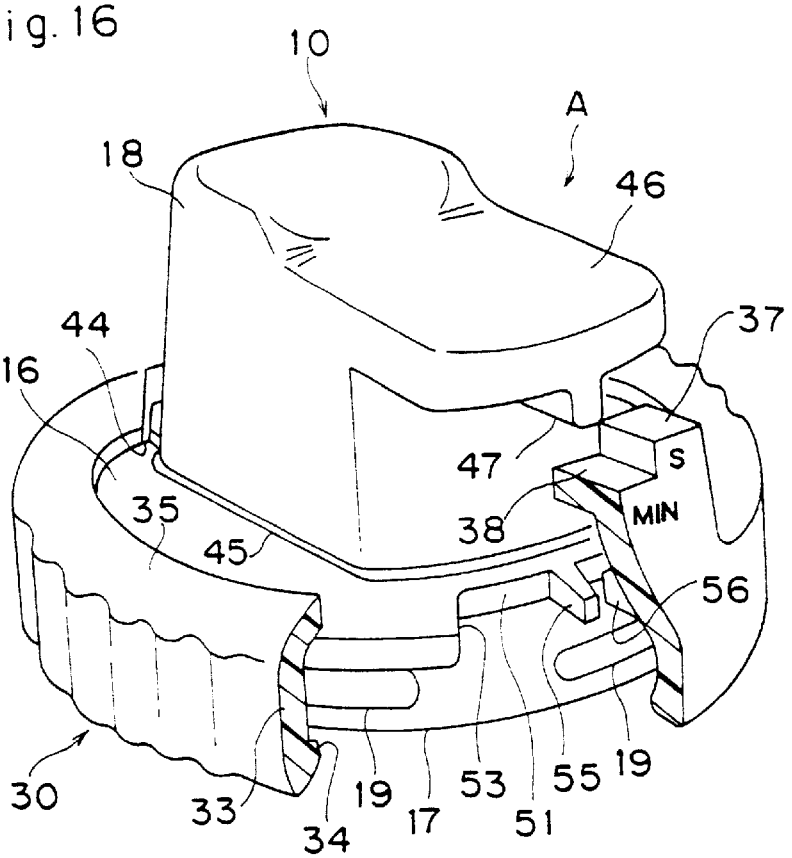
FIG. 16 is a partially exploded perspective view of the nozzle shown in FIG. 14.

Next, a further example of the invention will be detailed with referring to FIGS. 14 to 19. As shown in FIGS. 14 to 16, the nozzle A comprises a nozzle body 10 and a cap member 30, each being separately formed by integral molding using synthetic resin. The nozzle body 10 has a cylindrical mounting part 17 with an outwardly extended flange 16, and a head 18 molded as projecting upwards of the flange 16. The mounting part 17 is provided on the outer periphery with a plurality of ridge-like ribs 19.

The nozzle body 10 has a spray port 41 opened at the front side of the nozzle body, namely, the front side of the head 18, and a communication passage 42 communicating with the spray port 41. The communication passage 42 communicates with a connection port 43 that is fit onto the projecting part 73 of the valve stem 7 explained in FIGS. 24 to 26. The head 18 of the nozzle body 10 is connected only at the front lower part with the mounting part 17, the connecting part being a hinge 44 which is thin in thickness and has elasticity. The mounting part 17 has an opening 45 through which the head 18 is allowed to swing vertically about the hinge 44. Hence, by user's pushing in a push controller 46 (described later) with a finger of his or her hand the head 18 can be depressed or return to its original position about the hinge 44 and in the direction of depression of the valve stem 7 explained in FIGS. 24 to 26.

The nozzle body 10 is provided with the push controller 46. The exemplified push controller 46 is made of an extension projecting rearwards of the rear side of the head 18. Hence, an interval between the hinge 44 and the push controller 46 is made longer, so that a smaller force (a depressing force) is enough to push in, by the finger, the push controller 46 about the hinge 44 thanks to a principle of "leverage".

As seen from FIG. 14, the nozzle body 10 is mounted to the container in such manner that the mounting part 17 is fit onto the inside of a mouth 100 of a mounting cup 110 of the container with a flange 16 being fit onto the mouth 100 and the connection port 43 fit onto the projecting part 73 of the valve stem 7 explained in FIGS. 24 to 26, whereby the stem hole 74 explained in FIGS. 24 to 26 communicates with the spray port 41 through the communication passage 42.

As shown in FIG. 14 or 16, the cap member 30 integrally includes a low cylindrical peripheral wall 33, a ring-like part 34 swelled inwardly at the Lower end of the peripheral wall 33, and a ring-like shoulder 35 extending inwardly at the upper end of the peripheral wall 33. The cap member 30 is rotatably fit at the peripheral wall 33 onto the outside of the mouth 100 and engages at the ring-like part 34 with the mouth 100 to prevent the peripheral wall 33 from falling off the mouth 100. The head 18 of the nozzle body 10 projects upwards through an opening encircled by the shoulder 35 of the cap member 30 rotatably mounted to the mouth 100 as above. The opening encircled by the shoulder 35 is in a shape to enable the cap member 30 to be mounted on the mouth 100 after passing the head 18 of the nozzle body 10 fixed on the mouth 100. The peripheral wall 33 is provided partially on the outer surface with a ridge and groove part which prevents slipping of user's hand when gripping and turning the cap member 30.

Figure 17:
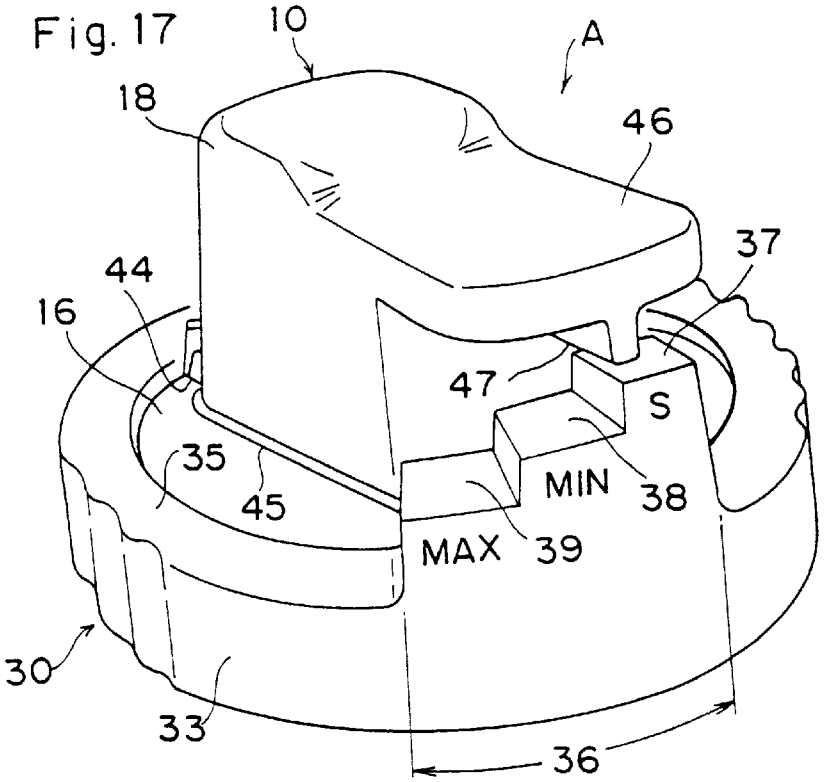
FIG. 17 is a perspective view of the same in the lock mode.
Figure 18:
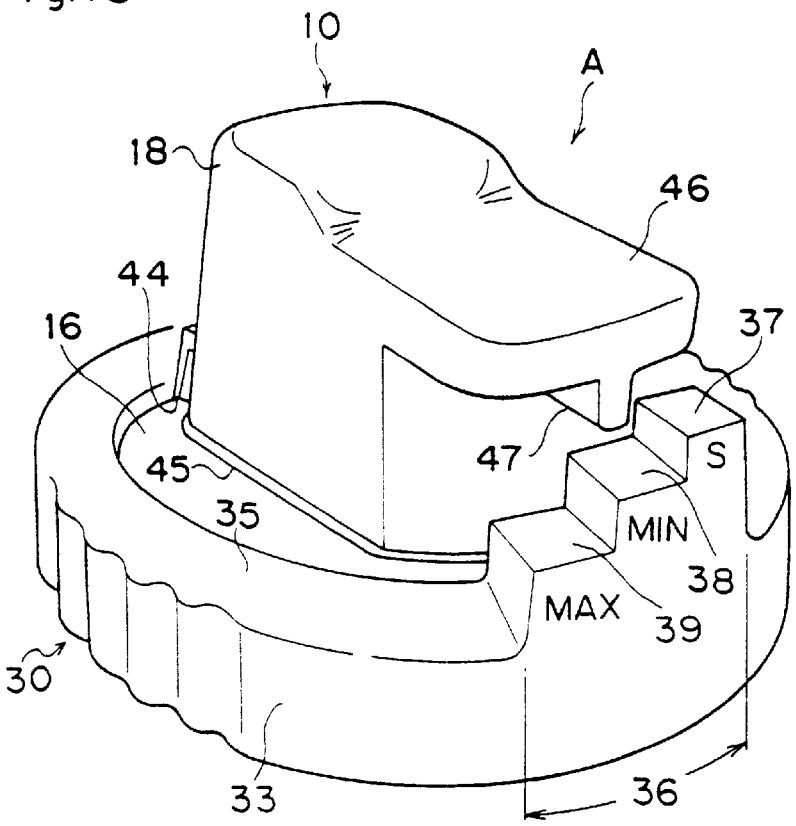
FIG. 18 is a perspective view of the same in the small quantity spray mode.
Figure 19:
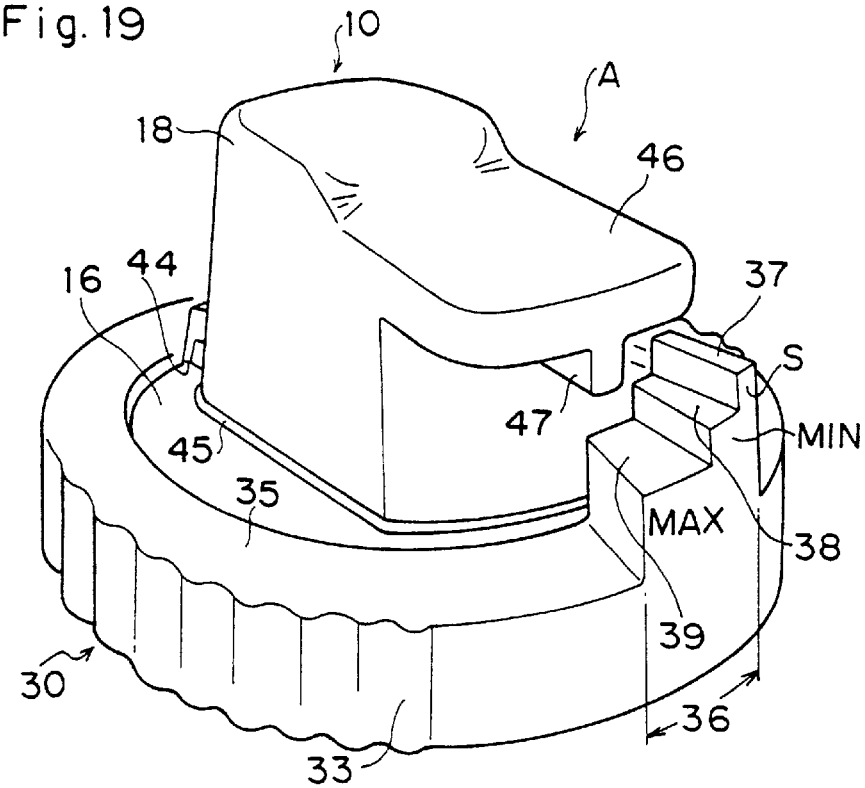
FIG. 19 is a perspective view of the same in the large quantity spray mode.

As shown in FIGS. 17 to 19, the cap member 30 is provided partially on its outer periphery with a depression depths limiting part 36. A corresponding abutting part 47 is formed on the rear surface of the push controller 46 of the head 18. The depression depths limiting part 36 includes three receiving parts different in height, i.e., an upper receiving part 37, a middle receiving part 38 and a lower receiving part 39. In this example, the heights of the receiving parts 37, 38 and 39 are made smaller in this order. By turning the cap member 30 any of the upper, middle or lower receiving parts 37, 38 or 39 can be selectively faced to the abutting part 47 correspondingly to specific rotation angles of the cap member 30.

As seen in FIGS. 14 to 16, the flange 16 of the nozzle body 10 is cut partially at its periphery to be recessed. Surfaces on both ends of the cut part 51 serve as stoppers 52 and 53 respectively. The flange 16 is also provided at two points between the stoppers 52 and 53 with partitions 54 and 55 projecting on the cut part 51. A corresponding projection 56 is provided on the inner surface of the peripheral wall 33 of the cap member 30 and projects inwards to be fit in the cut part 51. Hence, a range of the rotation angles of the cap member 30 is limited to an extent between two points where the projection 56 engages with one stopper 52 and the other stopper 53. When the cap member 30 is turned to move the projection 56 in the cut part 51 circumferentially of the flange 16, the projection 56 first abuts against one of the partitions 54 and 55 and then gets over the same. The projection 56 and partitions 54, 55 are made of synthetic resin, so that when the projection 56 gets over, for example, the partition 54, at least one of the projection 56 and the partition 54 elastically deforms. After the projection 56 gets over the partition 54, the deformed one restores elastically to its original figure. There occurs the same function when and after the projection 56 gets over the other partition 55. That one component deformed when the projection 56 gets over the partition 54 or 55 makes sounds or noises or vibration when it restores elastically, such sounds or noises or vibration being transmitted as feelings to user's ears or hand grasping the cap member 30.

The two stopers 52 and 53 formed at the flange 16 and the depression depths limiting part 36 on the cap member 30 are correlated in positions of arrangement to each other. In detail, the arrangement postions of the two stoppers 52, 53 are determined in such manner that the rotation angle range of the cap member 30 limited collectively by the projection 56 and the two stoppers 52 and 53 is in an extent that the abutting part 47 always faces to the depression depths limiting part 36. Furthermore, arrangement positions of the two partitions 54, 55 on the flange 16 are correlated to those of the upper, middle and lower receiving parts 37, 38 and 39 of the depression depths limiting part 36. in detail, one partition 54 corresponds in arrangement position to the border between the upper and the middle receiving parts 37 and 38, and the other partition 55 to that between the middle and the lower receiving parts 38 and 39. Hence, when the cap member 30 is turned to allow the abutting part 47 to be placed within a reach wherein the abutting part 47 faces to the upper or the middle receiving part 37 and 38, the projection 56 gets over one partition 54. And when the abutting part 47 is placed within a reach wherein it faces to the middle or the lower receiving part 38 and 39, the projection 56 gets over the other partition 55.

The nozzle A explained in the example shown in FIGS. 14 to 19 is mounted, for use, on the flow control valve 5 explained in FIGS. 24 to 26. In this case, the height of the upper receiving part 37 of the depression depths limiting part 36 is arranged at a point where the upper receiving part 37 receives the abutting part 47 when the valve stem 7 is applied with a depressing force through the push controller 46 and before the valve stem 7 reaches the first depression zone S1. Hence, the cap member 30 is turned to cause the upper receiving part 37 to face to the abutting part 47 as seen in FIG. 17, whereby a lock mode sets in. In the lock mode, even when the push controller 46 is pushed in, the upper receiving part 37 receives the abutting part 47 to prevent the valve stem 7 from reaching the first depression zone S1, so that no spray is carried out.

The height of the middle receiving part 38 of the depression depths limiting part 36 is arranged at a point where the middle receiving part 37 receives the abutting part 47 when the valve stem 7 is applied with a depressing force through the push controller 46 and at a point where the valve stem 7 reaches the first depression zone S1. Hence, the cap member 30 is turned to cause the middle receiving part 38 to face to the abutting part 47 as seen in FIG. 18, whereby a small quantity spray mode sets in. In the small quantity spray mode, when the push controller 46 is pushed in, the valve stem 7 reaches the first depression zone S1, so that a small quantity of spray is performed.

The height of the lower receiving part 39 of the depression depths limiting part 36 is arranged at a point where the lower receiving part 39 receives the abutting part 47 when the valve stem 7 is applied with a depressing force through the push controller 46 and at a point where the valve stem 7 reaches the second depression zone S2. Hence, the cap member 30 is turned to cause the lower receiving part 39 to face to the abutting part 47 as seen in FIG. 19, whereby a large quantity spray mode sets in. In the large quantity spray mode, when the push controller 46 is pushed in, the valve stem 7 reaches the second depression zone S2, so that a large quantity of spray is performed.

In FIG. 14, the depressible depths of the push controller 46 in the small quantity spray mode is indicated by H1, and that in the large quantity spray mode by H2.

In this example, the upper, middle and lower receiving parts 37, 38 and 39 are marked as "S", "MIN" and "MAX" each indicating the respective mode, whereby users can precisely select a desired one among the modes.

In the example shown in FIGS. 14 to 19, the upper, middle and lower receiving parts 37, 38 and 39 of the depression depths limiting part 36 are seen from the outside of the container to be conspicuous or noticeable and may look unshapely or ungainly. A further example to avoid such clumsiness is shown in FIGS. 20 and 21.

Figure 20:
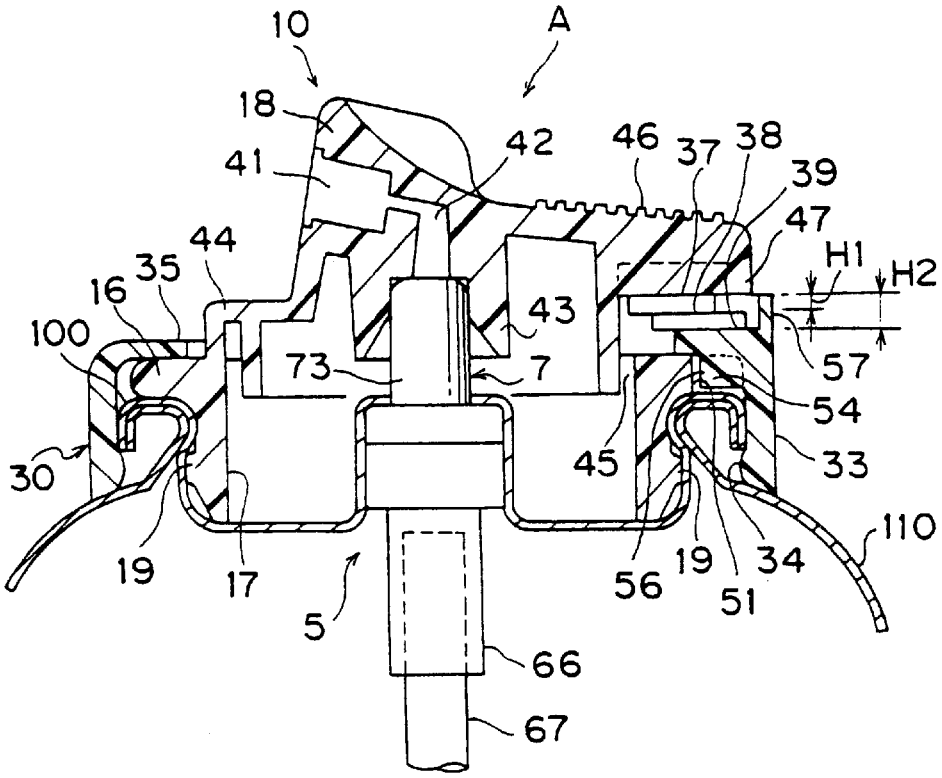
FIG. 20 is a longitudinally sectional side view showing a spray quantity control nozzle in a further example according to the present invention mounted to the mouth of an aerosol container.
Figure 21:
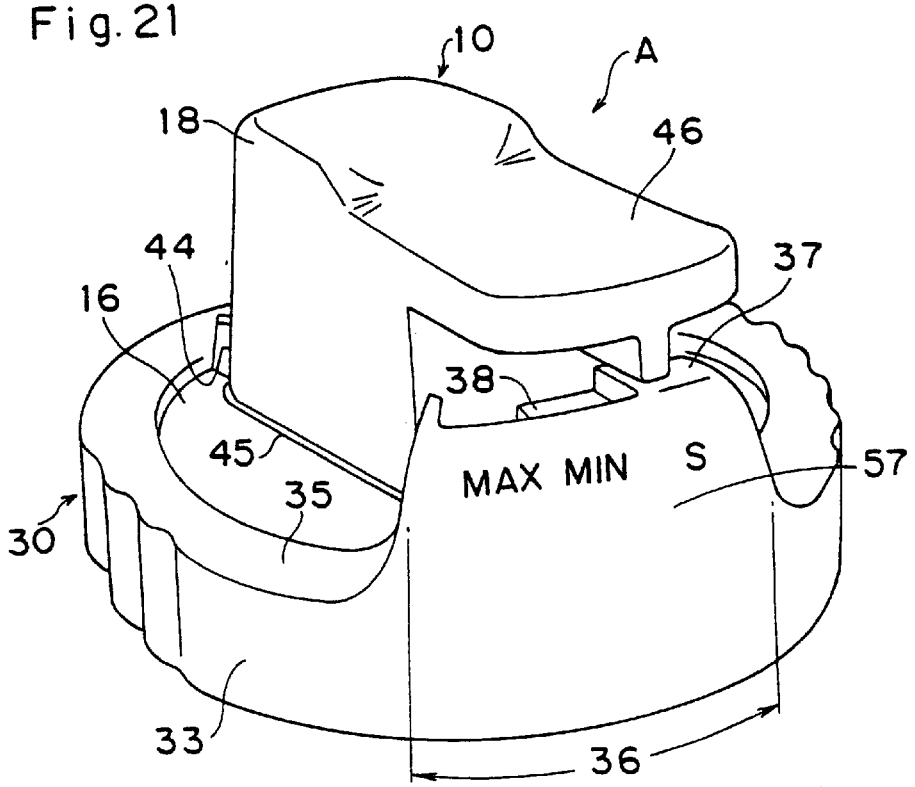
FIG. 21 is a perspective view of the nozzle shown in FIG. 20 in the lock mode.

In the spray quantity control nozzle A shown in FIGS. 20 and 21, the cap member 30 is provided at the outside of the depression depths limiting part 36 with a shield wall 57 which extends upwardly of the outer periphery of the cap member 30 integrally therewith. The upper, middle and lower receiving parts 37, 38, 39 are consecutively formed at the rear side of the shield wall 57 integrally therewith. Other features are the same as those referred to in the example shown in FIGS. 14 to 19 and are not detailed here for convenience of explanation, with the same or corresponding parts being marked with the same reference numbers or signs.

Figure 22:
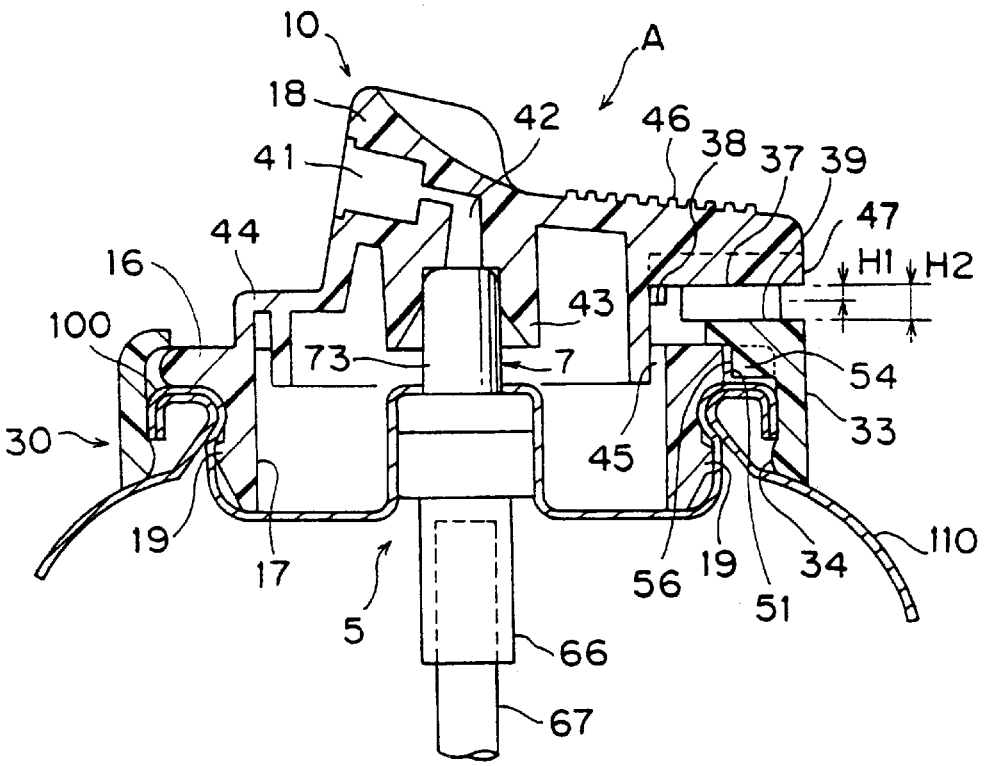
FIG. 22 is a longitudinally sectional side view of a spray quantity control nozzle in a further example according to the present invention mounted to the mouth of an aerosol container.
Figure 23:
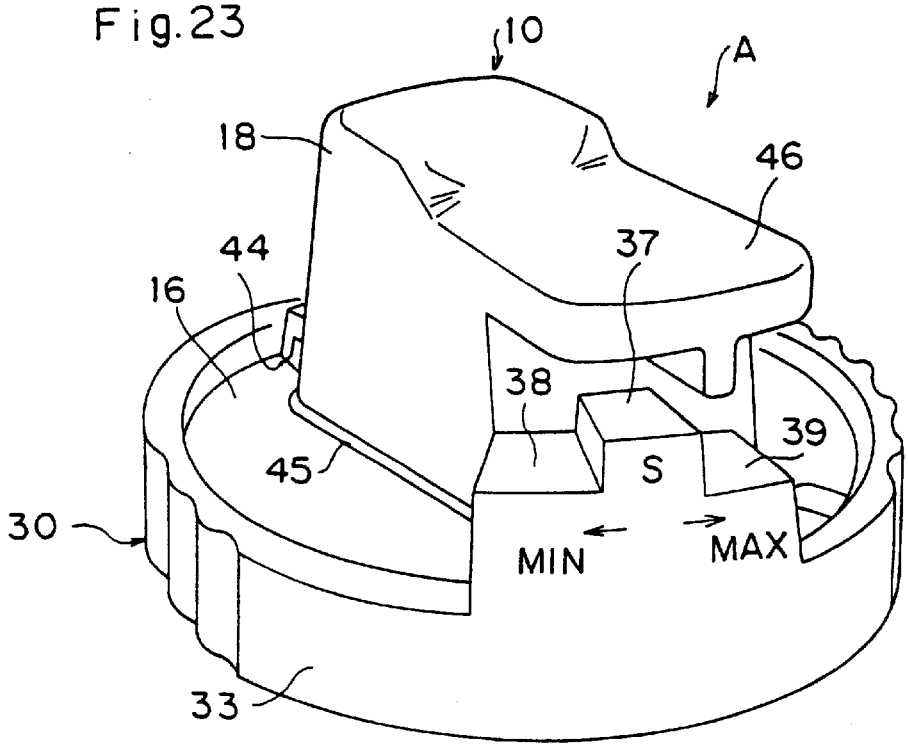
FIG. 23 is a perspective view of the nozzle shown in FIG. 22 in the large quantity spray mode.

The order of arrangement of the upper, middle and lower receiving parts 37, 38, 39 at the depression depths limiting part 36 may be freely determined and may interpose the upper receiving part 37 between the middle and lower receiving parts 38 and 39 circumferentially of the cap member 30 as shown in FIGS. 22 and 23. Other features of the nozzle A shown in FIGS. 22 and 23 are the same as those referred to in the example shown in FIGS. 14 to 19 and are not detailed here, with the same or corresponding parts being marked with the same reference numbers or signs.

In the examples illustrated in FIGS. 14 to 23, the projection 56 is formed on the cap member 30, and the stoppers 52, 53 and partitions 54, 55 on the nozzle body 10. The arrangement positions of these components may be reversed as the projection 56 at the nozzle body and the stoppers and partitions on the cap member.

The flow control valve 5 shown in FIGS. 24 to 26 referred to in the above explanation is an example of the valves with which the nozzle A according to the present invention is usable in association. The nozzle A of the present invention may be coupled for use with any other kinds of flow control valves which comprises a valve stem and has such functions that a passage for the contents of the aerosol container is closed when the valve stem is positioned at an initial position and is opened when the valve stem at the initial position is depressed; and quantities of the contents flowing through the passage are varied in two stages when the valve stem is depressed into a first depression zone corresponding to a smaller depression of the valve stem from the initial position or into a second depression zone corresponding to a larger depression of the valve stem from the initial position.

What is claimed is:

1. A spray quantity control nozzle for an aerosol container comprising:

the aerosol container having a passage for contents thereof and being provided with a flow control valve and a valve stem, the flow control valve having such functions that the passage of the contents of the aerosol container is closed when the valve stem is positioned in an initial position and is opened when the valve stem at the initial position is depressed, and quantities of the contents flowing through the passage are varied in two stages when the valve stem is depressed into a first depression zone corresponding to a smaller depression of the valve stem from the initial position or into a second depression zone corresponding to a larger depression of the valve stem from the initial position, and the spray quantity control nozzle including: a nozzle body mounted onto the valve stem; a cap member fit onto the outside of and rotatably mounted to a mouth of the aerosol container, which mouth is arranged to encircle the valve stem; a depression depths limiting part formed on the cap member; a spray port formed on the nozzle body, opened at the front side thereof and communicating with the passage of contents of the aerosol container; a push controller made of an extension projecting backwards of the nozzle body; a head part formed on the nozzle body and having an abutting part which is faced to the depression depths limiting part when the valve stem is positioned in the initial position; an upper receiving part which is formed at the depression depths limiting part and receives the abutting part when a depressing force is applied to the valve stem through the push controller and before the valve stem reaches the first depression zone; a middle receiving part which is formed at the depression depths limiting part to line up with the upper receiving part in the direction of rotation of the cap member and receives the abutting part when a depressing force is applied to the valve stem through the push controller and at a point where the valve stem reaches the first depression zone; and a lower receiving part which is formed at the depression depths limiting part to line up with the upper or the middle receiving part in the direction of rotation of the cap member and receives the abutting part when a depressing force is applied to the valve stem through the push controller and at a point where the valve stem reaches the second depression zone.

2. A spray quantity control nozzle for an aerosol container as set forth in claim 1, wherein one of the nozzle body and the cap member is provided with a projection and the other is provided at two points in its circumferential direction with stoppers which each engages with the projection, by rotation of the cap member, to limit a range of rotation angles of the cap member to such extent that the abutting part exists within a reach where the abutting part is able to always face to the depression depths limiting part, and a partition means is formed on the said other at two points between the two stoppers which partition means the projection gets over when the cap member is turned to allow the abutting part to be placed within a reach wherein the abutting part is able to face to the upper, the middle or the lower receiving part, so that when the projection gets over each partition means, at least one of the projection or the partition means elastically deforms.

3. A spray quantity control nozzle for an aerosol container as set forth in claim 2, wherein the nozzle body is provided with a mounting part fit onto the inside of and mounted to the mouth of the aerosol container, and with a flange extended from the mounting part to be fit onto the mouth of the container; the head part of the nozzle body is connected to the mounting part through a hinge to be depressed and withdraw in the direction of depression of the valve stem; the said other corresponds to the nozzle body; and the stoppers and the partition means are provided at the flange.

4. A spray quantity control nozzle for an aerosol container as set forth in claim 2, wherein the nozzle body is provided with a mounting part fit onto the inside of and mounted to the mouth of the aerosol container, and with a flange extended from the mounting part to be fit onto the mouth of the container; the head part of the nozzle body is connected to the mounting part through a hinge to be depressed and withdraw in the direction of depression of the valve stem; the said other corresponds to the cap member; and the stoppers and the partition means are provided at the cap member.

5. A spray quantity control nozzle for an aerosol container as set forth in claim 1, wherein a shield wall is formed at the outside of the depression depths limiting part on the cap member to extend upwardly from and integrally with the outer periphery of the cap member, and the upper, the middle and the lower receiving parts of the depression depths limiting part are consecutively provided at the rear side of the shield wall integrally therewith.

* * * * *